US010358997B1

(12) United States Patent
Anschuetz et al.

(10) Patent No.: US 10,358,997 B1
(45) Date of Patent: Jul. 23, 2019

(54) METHOD FOR CONTROLLING A MARINE INTERNAL COMBUSTION ENGINE

(71) Applicant: Brunswick Corporation, Mettawa, IL (US)

(72) Inventors: Steven M. Anschuetz, Fond du Lac, WI (US); Robert R. Osthelder, Omro, WI (US); William P. O'Brien, Eden, WI (US)

(73) Assignee: Brunswick Corporation, Mettawa, IL (US)

( * ) Notice: Subject to any disclaimer, the term of this patent is extended or adjusted under 35 U.S.C. 154(b) by 63 days.

(21) Appl. No.: 15/843,275

(22) Filed: Dec. 15, 2017

(51) Int. Cl.

| | |
|---|---|
| ***F02D 41/26*** | (2006.01) |
| ***F02D 41/14*** | (2006.01) |
| ***B63H 21/14*** | (2006.01) |
| ***B63H 21/21*** | (2006.01) |

(52) U.S. Cl.
CPC ..... *F02D 41/1454* (2013.01); *B63H 21/14* (2013.01); *B63H 21/21* (2013.01); *B63B 2758/00* (2013.01); *F02D 2200/021* (2013.01); *F02D 2200/0404* (2013.01); *F02D 2200/0614* (2013.01); *F02D 2200/101* (2013.01); *F02D 2200/703* (2013.01)

(58) Field of Classification Search
CPC ..... F02D 41/1454; F02D 41/1475; F02D 11/105; F02D 2250/21; F02D 2200/0404; F02D 2200/703; F02D 2200/0614; F02D 2200/021; F02D 2200/101; B63H 21/21; B63H 21/14; B63B 2758/00
USPC ..... 123/399, 436, 443; 701/103, 110
See application file for complete search history.

(56) References Cited

U.S. PATENT DOCUMENTS

| | | | |
|---|---|---|---|
| 5,713,339 | A | 2/1998 | Kishida et al. |
| 5,848,582 | A | 12/1998 | Ehlers et al. |
| 5,924,404 | A | 7/1999 | Ruman et al. |
| 5,988,139 | A | 11/1999 | Wasilewski et al. |

(Continued)

OTHER PUBLICATIONS

Snyder, Matthew W., "Methods and Systems for Encoder Synchronization Using Spark and Fuel Modification", Unpublished U.S. Appl. No. 14/695,660, filed Apr. 24, 2015.

(Continued)

*Primary Examiner* — Hai H Huynh
(74) *Attorney, Agent, or Firm* — Andrus Intellectual Property Law, LLP

(57) ABSTRACT

A method for controlling a marine internal combustion engine includes operating the engine in a lean-burn mode, wherein a first fuel/air equivalence ratio of an air/fuel mixture in a combustion chamber of the engine is less than 1. The method includes comparing a change in operator demand to a delta demand deadband; comparing a speed of the engine to an engine speed deadband; and comparing a throttle position setpoint to a throttle position threshold. The method also includes immediately disabling the lean-burn mode in response to: (a) the change in operator demand being outside the delta demand deadband, and (b) at least one of: (i) the engine speed being outside the engine speed deadband, and (ii) the throttle position setpoint exceeding the throttle position threshold. The engine thereafter operates according to a set of mapped parameter values configured to achieve a second fuel/air equivalence ratio of at least 1.

20 Claims, 13 Drawing Sheets

(56) References Cited

U.S. PATENT DOCUMENTS

| | | | | |
|---|---|---|---|---|
| 6,167,979 | B1 * | 1/2001 | Taylor | B60K 31/04 123/357 |
| 6,196,188 | B1 * | 3/2001 | Janic | F02D 11/105 123/350 |
| 6,250,292 | B1 | 6/2001 | Suhre | |
| 6,273,771 | B1 | 8/2001 | Buckley et al. | |
| 6,298,824 | B1 | 10/2001 | Suhre | |
| 6,311,679 | B1 | 11/2001 | Druzhinina et al. | |
| 6,726,512 | B2 | 4/2004 | Saito | |
| 6,757,606 | B1 | 6/2004 | Gonring | |
| 6,758,185 | B2 | 7/2004 | Surnilla et al. | |
| 8,725,390 | B1 | 5/2014 | Snyder et al. | |
| 9,067,662 | B2 | 6/2015 | Sako et al. | |
| 9,643,698 | B1 * | 5/2017 | Andrasko | B63B 45/04 |
| 10,094,321 | B1 * | 10/2018 | Anschuetz | F02D 41/1495 |

OTHER PUBLICATIONS

Attainable Adventure Cruising, "Understanding an Engine Fuel Map", Chapter 2 of Online Book "Engines for Cruising Boats", Jun. 2, 2015, last accessed Apr. 7, 2017, available at https://www.morganscloud.com/2015/06/02/understandinganenginefuelmap/.

Anschuetz et al., "Method for Controlling a Marine Internal Combustion Engine", Unpublished U.S. Appl. No. 15/597,749, filed May 17, 2017.

Anschuetz et al., "Method for Controlling a Marine Internal Combustion Engine", Unpublished U.S. Appl. No. 15/597,752, filed May 17, 2017.

Anschuetz et al., "Method for Controlling a Marine Internal Combustion Engine", Unpublished U.S. Appl. No. 15/597,760, filed May 17, 2017.

* cited by examiner

METHOD FOR CONTROLLING A MARINE INTERNAL COMBUSTION ENGINE

FIELD

The present disclosure relates to internal combustion engines used to power marine propulsion devices on marine vessels.

BACKGROUND

U.S. Pat. No. 5,848,582 discloses a control system for a fuel injector system for an internal combustion engine that is provided with a method by which the magnitude of the start of air point for the injector system is modified according to the barometric pressure measured in a region surrounding the engine. This offset, or modification, of the start of air point adjusts the timing of the fuel injector system to suit different altitudes at which the engine may be operating.

U.S. Pat. No. 5,924,404 discloses a direct fuel injected two-stroke engine that controls spark ignition timing and/or ignition coil dwell time on a cylinder-specific basis. The engine also preferably controls fuel injection timing and amount and injection/delivery duration on a cylinder-specific basis. Cylinder-specific customization of spark ignition and fuel injection allows better coordination of spark with fuel injection which results in better running quality, lower emissions, etc. Memory in the electronic control unit for the engine preferably includes a high resolution global look-up table that determines global values for spark ignition and fuel injection control based on engine load (e.g. operator torque demand, throttle position, manifold air pressure, etc.) and engine speed. Memory in the electronic control unit also includes a plurality of low resolution, cylinder-specific offset value look-up tables from which cylinder-specific offset values for spark ignition and fuel injection can be determined, preferably depending on engine load and engine speed. The offset values are combined with the global values to generate cylinder-specific control signals for spark ignition and fuel injection.

U.S. Pat. No. 5,988,139 discloses an engine control system that digitally stores corresponding values of timing angles and engine speeds and selects the timing angles based on the operating speed of the engine. In the engine speed range near idle speed, the timing angle is set to a pre-selected angle after top dead center (ATDC) and the relationship between engine speed and timing angle calls for the timing angle to be advanced from the pre-selected angle after top dead center (ATDC) to successively advancing angles which subsequently increase angles before top dead center (BTDC) as the engine increases in speed. In one application, a timing angle of 10 degrees after top dead center (ATDC) is selected for a engine idle speed of approximately 800 RPM. This relationship, which is controlled by the engine control unit, avoids stalling the engine when an operator suddenly decreases the engine speed.

U.S. Pat. No. 6,250,292 discloses a method which allows a pseudo throttle position sensor value to be calculated as a function of volumetric efficiency, pressure, volume, temperature, and the ideal gas constant in the event that a throttle position sensor fails. This is accomplished by first determining an air per cylinder (APC) value and then calculating the mass air flow into the engine as a function of the air per cylinder (APC) value. The mass air flow is then used, as a ratio of the maximum mass air flow at maximum power at sea level for the engine, to calculate a pseudo throttle position sensor value. That pseudo TPS (BARO) value is then used to select an air/fuel target ratio that allows the control system to calculate the fuel per cycle (FPC) for the engine.

U.S. Pat. No. 6,298,824 discloses a control system for a fuel injected engine including an engine control unit that receives signals from a throttle handle that is manually manipulated by an operator of a marine vessel. The engine control unit also measures engine speed and various other parameters, such as manifold absolute pressure, temperature, barometric pressure, and throttle position. The engine control unit controls the timing of fuel injectors and the injection system and also controls the position of a throttle plate. No direct connection is provided between a manually manipulated throttle handle and the throttle plate. All operating parameters are either calculated as a function of ambient conditions or determined by selecting parameters from matrices which allow the engine control unit to set the operating parameters as a function of engine speed and torque demand, as represented by the position of the throttle handle.

U.S. Pat. No. 6,757,606 discloses a method for controlling the operation of an internal combustion engine that includes the storing of two or more sets of operational relationships which are determined and preselected by calibrating the engine to achieve predetermined characteristics under predetermined operating conditions. The plurality of sets of operational relationships are then stored in a memory device of a microprocessor and later selected in response to a manually entered parameter. The chosen set of operational relationships is selected as a function of the selectable parameter entered by the operator of the marine vessel and the operation of the internal combustion engine is controlled according to that chosen set of operational parameters. This allows two identical internal combustion engines to be operated in different manners to suit the needs of particular applications of the two internal combustion engines.

U.S. Pat. No. 8,725,390 discloses systems and methods for optimizing fuel injection in an internal combustion engine that adjust start of fuel injection by calculating whether one of advancing or retarding start of fuel injection will provide a shortest path from a source angle to a destination angle. Based on the source angle and a given injection pulse width and angle increment, it is determined whether fuel injection will overlap with a specified engine event if start of fuel injection is moved in a direction of the shortest path. A control circuit increments start fuel injection in the direction of the shortest path if it is determined that fuel injection will not overlap with the specified engine event, or increments start fuel injection in a direction opposite that of the shortest path if it is determined that fuel injection will overlap with the specified engine event.

U.S. Pat. No. 10,094,321 discloses a method for controlling a marine internal combustion engine, which is carried out by a control module and includes: operating the engine according to a initial set of mapped parameter values configured to achieve a first fuel-air equivalence ratio in a combustion chamber of the engine; measuring current values of engine operating conditions; and comparing the engine operating conditions to predetermined lean-burn mode enablement criteria. In response to the engine operating conditions meeting the lean-burn enablement criteria, the method includes: (a) automatically retrieving a subsequent set of mapped parameter values configured to achieve a second, lesser fuel-air equivalence ratio and transitioning from operating the engine according to the initial set of mapped parameter values to operating the engine according to the subsequent set of mapped parameter values; or (b)

presenting an operator-selectable option to undertake such a transition, and in response to selection of the option, commencing the transition.

Unpublished U.S. patent application Ser. No. 15/597,752, filed May 17, 2017, discloses a method for controlling a marine engine including operating the engine according to an initial set of mapped parameter values to achieve a first target fuel-air equivalence ratio, determining a first actual fuel-air equivalence ratio, and using a feedback controller to minimize a difference between the first target and actual ratios. Feedback controller outputs are used to populate an initial set of adapt values to adjust combustion parameter values from the initial set of mapped parameter values. The method includes transitioning to operating the engine according to a subsequent set of mapped parameter values to achieve a different target fuel-air equivalence ratio. The method includes determining a second actual fuel-air equivalence ratio, using the feedback controller to minimize a difference between the second target and actual ratios, and using feedback controller outputs to populate a subsequent set of adapt values to adjust combustion parameter values from the subsequent set of mapped parameter values.

Unpublished U.S. patent application Ser. No. 15/597,760, filed May 17, 2017, discloses a marine engine operating according to first and second sets of mapped parameter values to achieve a first fuel-air equivalence ratio and maintaining a stable output torque while transitioning to operating according to third and fourth sets of mapped parameter values to achieve a different fuel-air equivalence ratio. The first and third sets of mapped parameter values correspond to a first combustion parameter. The second and fourth sets correspond to a second combustion parameter. The transition includes: (a) transitioning from operation according to a current value of the first combustion parameter to operation according to a target value thereof; (b) transitioning from operation according to a current value of the second combustion parameter to operation according to a target value thereof; and (c) timing commencement or completion of step (b) and setting a rate of step (b) to counteract torque discontinuity that would otherwise result when performing step (a) alone.

The above-noted patents and patent applications are hereby incorporated by reference in their entireties.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

A method for controlling a marine internal combustion engine is described in one example of the present disclosure. The method is carried out by a control module and comprises operating the engine according to a first set of mapped parameter values configured to achieve a first fuel/air equivalence ratio of an air-fuel mixture in a combustion chamber of the engine. In response to predetermined criteria being met, the method includes gradually transitioning to operating the engine according to a second set of mapped parameter values configured to achieve a second, different fuel-/air equivalence ratio of the air-fuel mixture in the combustion chamber. The method also includes comparing a change in operator demand to a delta demand deadband, and in response to the change in operator demand being outside the delta demand deadband during the step of transitioning, immediately thereafter operating the engine according to the second set of mapped parameter values.

Another method for controlling a marine internal combustion engine, the method being carried out by a control module, comprises operating the engine according to a first set of mapped parameter values configured to achieve a first fuel/air equivalence ratio of an air-fuel mixture in a combustion chamber of the engine. The method includes comparing a change in operator demand to a delta demand deadband; comparing a speed of the engine to an engine speed deadband; and comparing a throttle position setpoint for the engine to a throttle position threshold. In response to: (a) the change in operator demand being outside the delta demand deadband, and (b) at least one of: (i) the engine speed being outside the engine speed deadband, and (ii) the throttle position setpoint exceeding the throttle position threshold, the control module immediately thereafter operates the engine according to a second set of mapped parameter values configured to achieve a second, different fuel/air equivalence ratio of the air-fuel mixture in the combustion chamber.

Another method for controlling a marine internal combustion engine, which is carried out by a control module, comprises operating the engine in a lean-burn mode, wherein a first fuel/air equivalence ratio of an air/fuel mixture in a combustion chamber of the engine is less than 1. The method includes comparing a change in operator demand to a delta demand deadband; comparing a speed of the engine to an engine speed deadband; and comparing a throttle position setpoint for the engine to a throttle position threshold. The method also includes immediately disabling the lean-burn mode in response to: (a) the change in operator demand being outside the delta demand deadband, and (b) at least one of: (i) the engine speed being outside the engine speed deadband, and (ii) the throttle position setpoint exceeding the throttle position threshold. The control module thereafter operates the engine according to a set of mapped parameter values configured to achieve a second fuel/air equivalence ratio of at least 1.

BRIEF DESCRIPTION OF THE DRAWINGS

The present disclosure is described with reference to the following Figures. The same numbers are used throughout the Figures to reference like features and like components.

DETAILED DESCRIPTION

In the present description, certain terms have been used for brevity, clarity and understanding. No unnecessary limitations are to be inferred therefrom beyond the requirement of the prior art because such terms are used for descriptive purposes only and are intended to be broadly construed.

Figure 1:
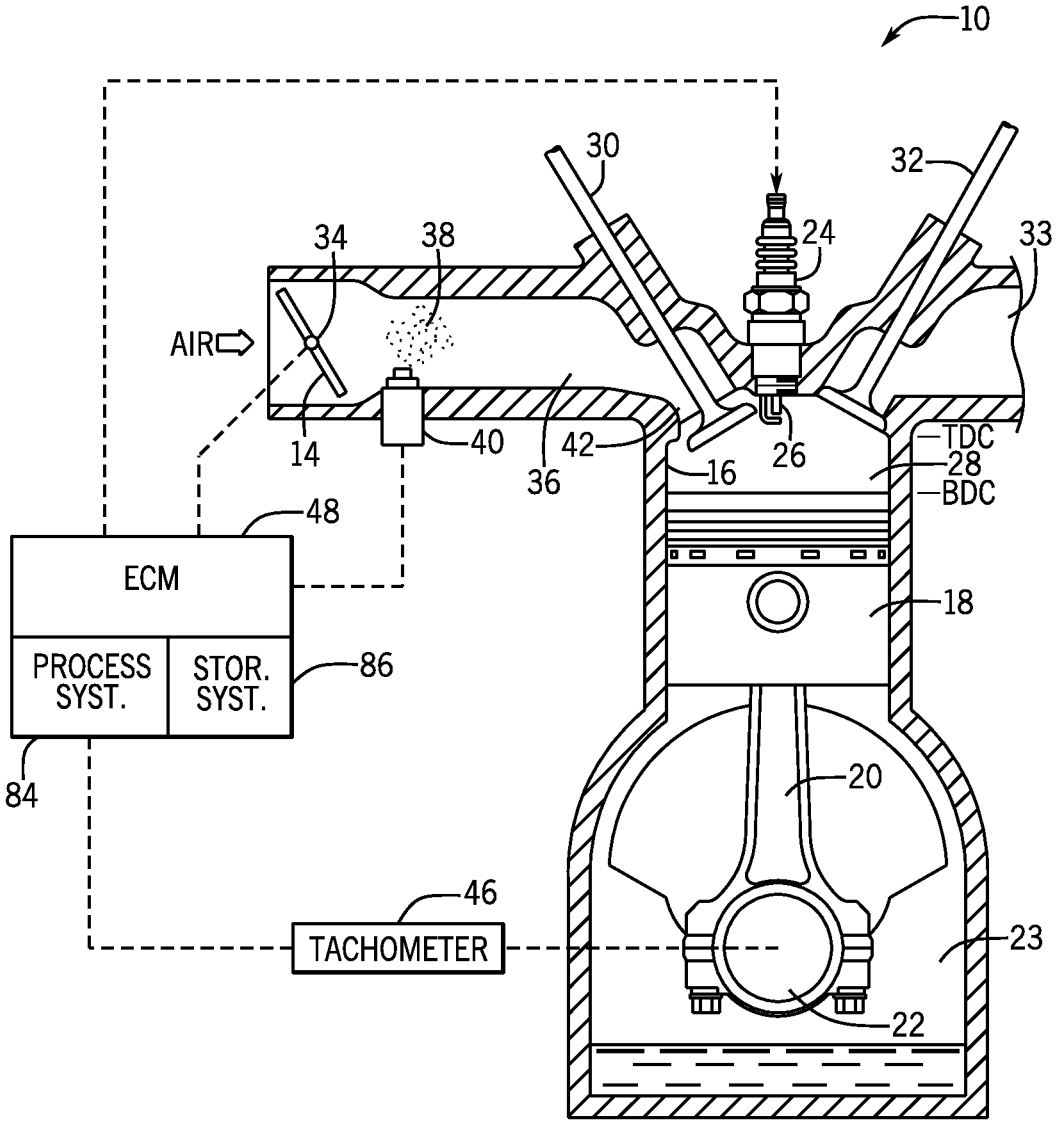
FIG. 1 is a schematic of a marine engine.

FIG. 1 shows an exemplary, but highly simplified, schematic of a four cycle internal combustion engine 10. Although only one cylinder 16 is shown, it should be understood that in most applications of internal combustion engines, a plurality of cylinders 16 are typically used. It should be understood that FIG. 1 is highly simplified for purposes of clarity and to permit the general operation of the internal combustion engine 10 to be described.

Within the cylinder 16, a piston 18 is disposed for reciprocating movement therein. The piston 18 is attached to a connecting rod 20 which, in turn, is attached to a crankshaft 22. The crankshaft 22 rotates about an axis within a crankcase 23, and this rotational movement causes the connecting rod 20 to move the piston 18 back and forth within the cylinder 16 between two limits of travel. The position shown in FIG. 1 represents the piston 18 at its bottom dead center (BDC) position within the cylinder 16. After the crankshaft 22 rotates 180 degrees about its axis, the piston 18 will move to its uppermost position at top dead center (TDC). A sparkplug 24 is configured to provide an igniting spark at its tip 26 to ignite a mixture of fuel and air within the combustion chamber 28.

An intake valve 30 and an exhaust valve 32 are shown, with the intake valve 30 being shown in an opened position and the exhaust valve 32 being shown in a closed position. A throttle valve 14 is shown as being pivotable about center 34 to regulate the flow of air through an air intake conduit 36 of the engine. Fuel 38 is introduced into the air intake conduit 36, in the form of a mist, through fuel injector 40. Although the engine 10 shown herein is an indirect injection engine, the present disclosure also relates to direct injection engines. It should also be understood that the location of the fuel injector 40 could be different from that shown herein, which is only for exemplary purposes. After combustion, byproducts are exhausted from combustion chamber 28 through exhaust valve 32 to exhaust conduit 33.

During operation of the engine shown in FIG. 1, air flows through the air intake conduit 36 under the control of the throttle valve 14. Fuel 38 introduced into the air stream as a mist passes with the air through an intake port 42, which conducts the air-fuel mixture into the combustion chamber 28. The timing of the engine determines the point, relative to the rotation of the crankshaft 22, when the sparkplug 24 is fired to ignite the air-fuel mixture within the combustion chamber 28. If the sparkplug 24 fires before the piston 18 reaches its uppermost position within cylinder 16, it is referred to as being fired before top dead center (BTDC). If the sparkplug 24 is fired when the piston 18 is on its way down from its uppermost position in FIG. 1, it is referred to as being fired after top dead center (ATDC). The crankshaft 22 rotates through 360 degrees of rotation as the piston 18 moves through its entire reciprocating motion. It is typical to refer to the timing of events related to combustion within an engine in terms of the crank angle before top dead center (BTDC) or after top dead center (ATDC), with reference to the position of the piston 18 when the event occurs.

With continued reference to FIG. 1, a tachometer 46 is shown schematically connected in signal communication with the crankshaft 22 or some other device, such as a gear tooth wheel, connected to the crankshaft 22 to allow its rotational speed to be measured. This information from the tachometer 46 is provided to the engine control module (ECM) 48. In a typical application, the engine control module 48 comprises a processor that digitally stores information necessary to allow the ECM 48 to control the timing of the engine 10. A signal is sent from the ECM 48 to an ignition system 76 (FIG. 2) or some other suitable device (e.g., ignition coils, power transistors) to cause the sparkplug 24 to fire.

The throttle valve 14 in FIG. 1 is typically caused to pivot about its center of rotation 34 by electro-mechanical movement of the throttle valve 14 in response to an operator command, as will be described below. In most applications, the throttle valve 14 can be moved from an open position to a closed position where the air passing through the air intake conduit 36 is virtually stopped. However, it should be understood that in most applications of internal combustion engines, means is generally provided to allow a small amount of air to bypass the plate of the throttle valve 14 during idle engine speed conditions in order to allow the engine 10 to continue to operate, although at a significantly reduced speed. This reduced flow of air can be provided by small holes formed through the throttle valve 14 or other bypass channels formed in the structure of the air intake conduit 36. It should be understood that movement of the throttle valve 14 from a closed position to an open position increases the operational speed of the engine and movement of the throttle valve 14 from an open position to a closed position reduces the operational speed of the engine.

Figure 2:
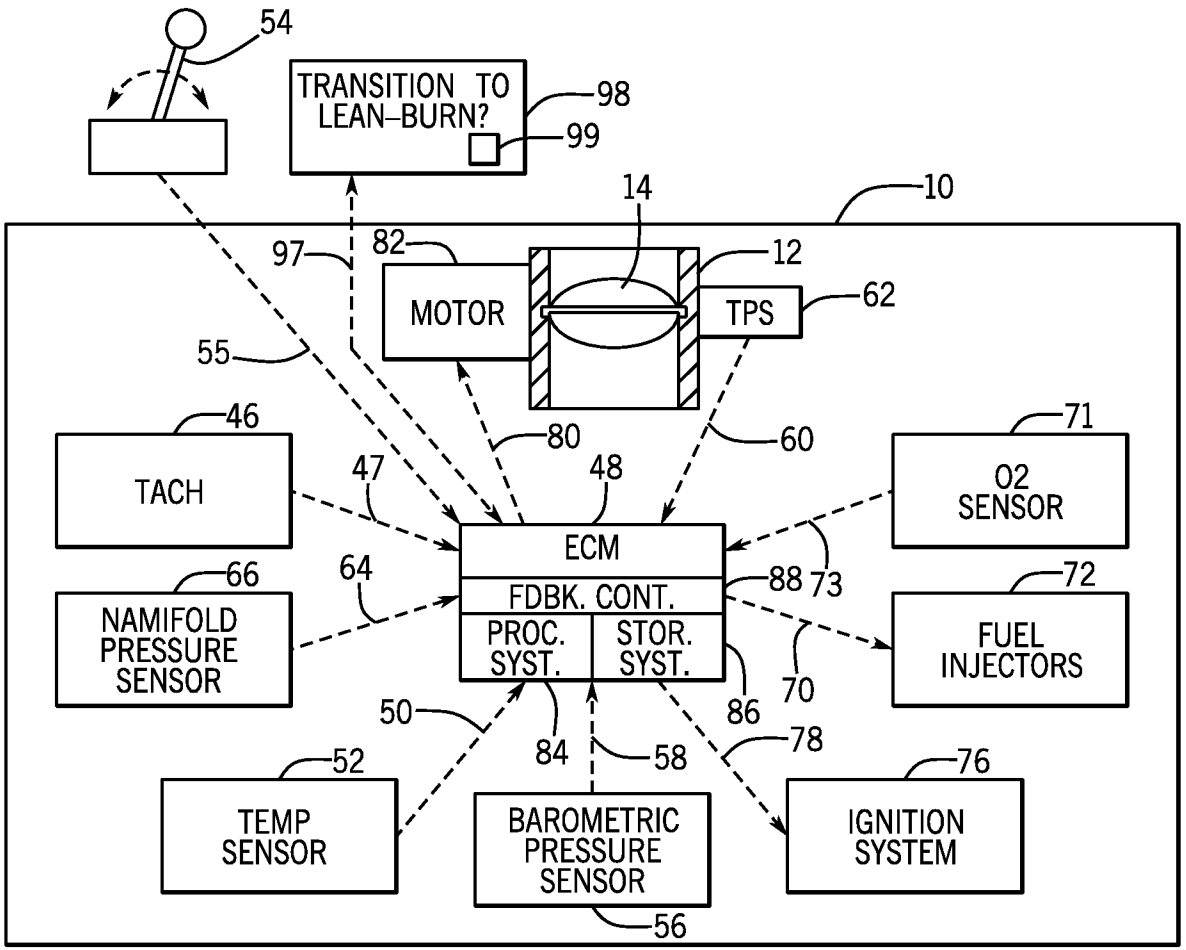
FIG. 2 is a schematic of a marine engine control system.

FIG. 2 is a highly simplified schematic representation of a control system for the engine 10 defining the cylinder 16 of FIG. 1. As noted herein above, as it enters the engine 10, air passes by the throttle valve 14, which is rotatably supported in a throttle body structure 12. The ECM 48 is shown as being connected in signal communication with several sensors in order to enable the ECM 48 to properly select the magnitudes of fuel and air that are provided to each cylinder of the engine 10. For example, the ECM 48 is provided with information that represents the actual angular position of the throttle valve 14. This information is provided on line 60 by a throttle position sensor 62.

With continued reference to FIG. 2, another one of the sensor signals provided to the ECM 48 represents the physical position of a throttle lever 54. The throttle lever 54 is manually moveable, and a signal is provided to the ECM 48 on line 55, which represents the position of the throttle lever 54. The signal on line 55 in turn represents an operator demand for desired torque or desired engine speed. The ECM 48 is also provided with a signal on line 47 representing actual engine speed. The signal can be provided by the tachometer 46 or any other instrument that is capable of providing a signal to the ECM 48 representing engine speed. On line 64, the ECM 48 is provided with a signal that is representative of manifold pressure, such as the pressure in air intake conduit 36. Any type of manifold pressure sensor 66 that is capable of providing information to the ECM 48 that is representative of manifold absolute pressure can be used for these purposes. On line 50, the ECM 48 is provided with information representing the temperature at one or more selective locations on the engine 10. Various types of temperature sensors 52 are suitable for these purposes. The ECM 48 is also provided with information regarding atmospheric pressure, from a barometric pressure sensor 56, on line 58. An oxygen sensor 71 provides a reading related to an amount of oxygen, for example in the engine's exhaust, to the ECM 48 on line 73. The oxygen sensor 71 may be a lambda sensor such as a wide-band oxygen sensor.

The ECM 48 provides certain output signals that allows it to control the operation of certain components relating to the engine 10. For example, the ECM 48 provides signals on line 70 to fuel injectors 72 to control the amount of fuel provided to each cylinder per each engine cycle. The ECM 48 also controls the ignition system 76, including the sparkplug 24, by determining the timing and spark energy of each ignition event. The output signals provided by the ECM 48 for these purposes are provided on line 78.

FIG. 2 shows the schematic representation of the various sensors and components that are used by the ECM 48 to control the operation of the engine 10 in direct response to the position of a throttle lever 54. It should be understood that the position of the throttle lever 54 is, in actuality, a demand by the operator of a marine vessel for a relative amount of torque to be provided to the propeller shaft of the propulsion system, or in another example, for a relative speed of the engine coupled to the propeller shaft. The position of the throttle lever 54 can be moved by the operator of the marine vessel at any time during the operation of the marine vessel. For example, if the marine vessel is traveling at a generally constant speed, the operator of the marine vessel can move the throttle lever 54 in one direction to increase the vessel speed by providing increased torque to the propeller shaft (or by increasing engine speed) or, alternatively, the operator of the marine vessel can move the throttle lever 54 in the opposite direction to decrease the amount of torque provided to the propeller shaft (or to decrease the engine speed) and, as a result, decrease the speed of the marine vessel. It should be noted that no direct physical connection need be provided between the throttle lever 54 and the throttle valve 14. Instead, the ECM 48 receives the operator demand signals on line 55 that represent the position of the throttle lever 54 and combines that information with other information relating to the operation of the engine 10 to provide appropriate signals on line 80. The signals on line 80 then cause a throttle motor 82 to rotate the throttle valve 14 to a desired position to achieve the operator demand received on line 55 from the throttle lever 54.

The ECM 48 may include a feedback controller 88 that uses the readings from the throttle lever 54, tachometer 46, oxygen sensor 71, throttle position sensor 62, and/or other sensors on the engine 10 or vessel to calculate the signals to be sent over line 80 to throttle motor 82, over line 78 to ignition system 76 (including sparkplug 24), and over line 70 to fuel injectors 72.

In the example shown, ECM 48 is programmable and includes a processor and a memory. The ECM 48 can be located anywhere in the system and/or located remote from the system and can communicate with various components of the marine vessel via a peripheral interface and wired and/or wireless links, as will be explained further herein below. Although FIGS. 1 and 2 each show only one ECM 48, the system can include more than one control module. Portions of the method disclosed herein below can be carried out by a single control module or by several separate control modules. If more than one control module is provided, each can control operation of a specific device or sub-system on the marine vessel.

In some examples, the ECM 48 may include a processing system 84, storage system 86, software, and input/output (110) interfaces for communicating with peripheral devices. The systems may be implemented in hardware and/or software that carries out a programmed set of instructions. For example, the processing system 84 loads and executes software from the storage system, which directs the processing system 84 to operate as described herein below in further detail. The system may include one or more processors, which may be communicatively connected. The processing system 84 can comprise a microprocessor, including a control unit and a processing unit, and other circuitry, such as semiconductor hardware logic, that retrieves and executes software from the storage system. The processing system 84 can be implemented within a single processing device but can also be distributed across multiple processing devices or sub-systems that cooperate according to existing program instructions.

As used herein, the term "control module" may refer to, be part of, or include an application specific integrated circuit (ASIC); an electronic circuit; a combinational logic circuit; a field programmable gate array (FPGA); a processor (shared, dedicated, or group) that executes code; other suitable components that provide the described functionality; or a combination of some or all of the above, such as in a system-on-chip (SoC). A control module may include memory (shared, dedicated, or group) that stores code executed by the processing system. The term "code" may include software, firmware, and/or microcode, and may refer to programs, routines, functions, classes, and/or objects. The term "shared" means that some or all code from multiple control modules may be executed using a single (shared) processor. In addition, some or all code from multiple control modules may be stored by a single (shared) memory. The term "group" means that some or all code from a single control module may be executed using a group of processors. In addition, some or all code from a single control module may be stored using a group of memories.

The storage system 86 can comprise any storage media readable by the processing system 84 and capable of storing software. The storage system 86 can include volatile and non-volatile, removable and non-removable media implemented in any method or technology for storage of information, such as computer-readable instructions, data structures, software program modules, or other data. The storage system 86 can be implemented as a single storage device or across multiple storage devices or sub-systems. The storage system 86 can include additional elements, such as a memory controller capable of communicating with the processing system. Non-limiting examples of storage media include random access memory, read-only memory, magnetic discs, optical discs, flash memory, virtual and non-virtual memory, various types of magnetic storage devices, or any other medium which can be used to store the desired information and that may be accessed by an instruction execution system. The storage media can be a transitory storage media or a non-transitory storage media such as a non-transitory tangible computer readable medium.

The ECM 48 communicates with one or more components of the control system via I/O interfaces and a communication link, which can be a wired or wireless link, and is shown schematically by lines 55, 47, 64, 50, 58, 78, 70, 73, 60, and 80. The ECM 48 is capable of monitoring and controlling one or more operational characteristics of the control system and its various subsystems by sending and receiving control signals via the communication link. In one example, the communication link is a controller area network (CAN) bus, but other types of links could be used. It should be noted that the extent of connections of the communication link shown herein is for schematic purposes only, and the communication link in fact provides communication between the ECM 48 and each of the peripheral devices and sensors noted herein, although not every connection is shown in the drawings for purposes of clarity.

Figure 3:
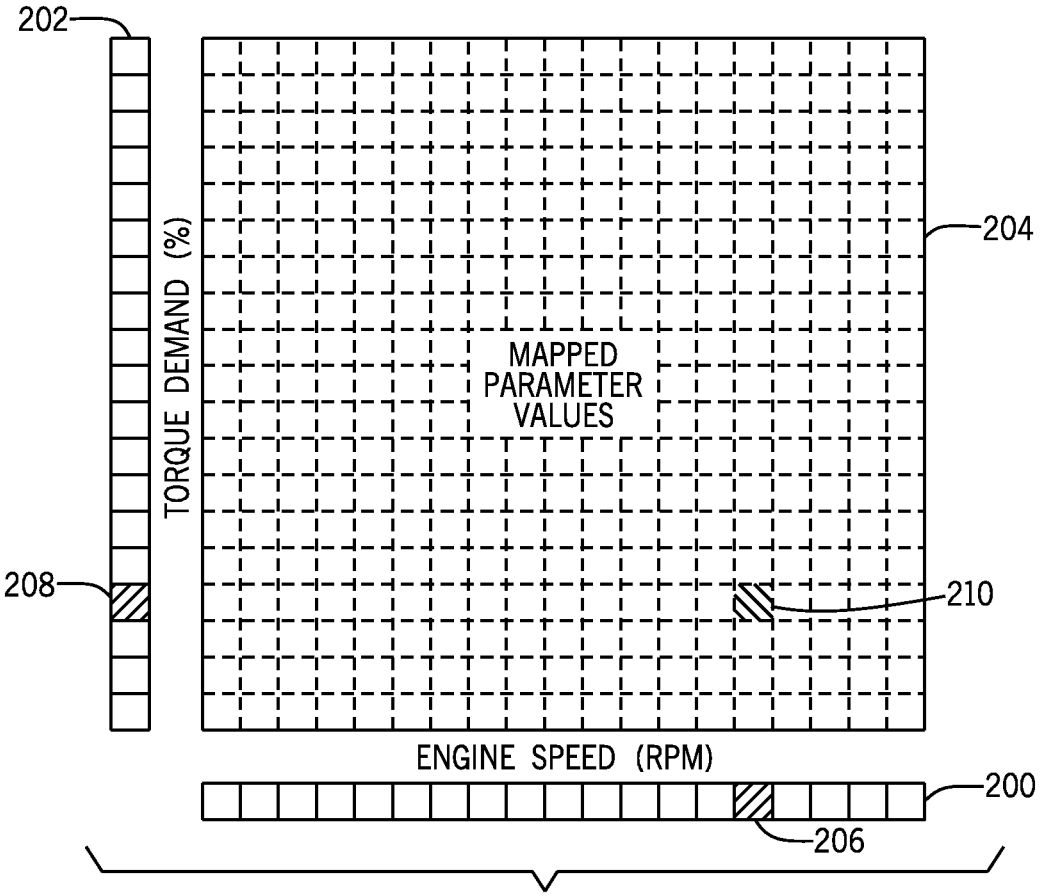
FIG. 3 illustrates a generic example of an input-output map for determining a generic engine control parameter.

In order to convert the input signal on line 55, which relates to the operator demand, to output signals on each of line 80 to move the throttle motor 82, line 78 to control the ignition system 76, and line 70 to control the fuel injectors 72, the ECM 48 uses a number of input-output maps saved in the storage system 86. FIG. 3 shows the basic structure of an input-output map 204 of a parameter value. The map shown in FIG. 3 does not contain any values and is intended to describe a basic concept used to implement the present methods. The mapped parameter values stored in the storage system 86 of the ECM 48 can be a fuel per cylinder (FPC), a throttle position setpoint (TPS), spark plug activation timing, or any other numeric parameter required by the present algorithms. In the example in which the operator demand represents a desired torque, most of the mapped parameter values used by the present algorithms are stored as a function of two measured variables, engine speed measured in RPM and operator demand measured as a percentage of maximum operator demand. The actual current engine speed is received by the ECM 48 on line 47 from the tachometer 46 or other sensor that is capable of providing a measured engine speed value. Operator demand is a value that represents the position of the throttle lever 54, stored as a percentage, of its maximum (i.e., fully forward) position. Both of the independent variables, engine speed and operator demand, are provided with an ordinate array, 200 and 202 respectively. The ordinate arrays are one dimensional arrays that contain values that allow the processing system 84 to select the appropriate row or column of the map 204 based on the independent variables measured by the sensors and provided to the ECM 48. For example, the ordinate array 200 associated with engine speed will contain magnitudes of RPM that represent the associated columns in the map 204. Similarly, the one dimensional array 202 would contain various percentages that assist the processing system 84 in selecting a row of the map 204. For example, if the engine speed is determined to match the category represented by entry 206 of ordinate array 200 and the operator demand is determined to be represented by the range contained in entry 208 of ordinate array 202, these two values are used to select the column and row, respectively, in the map 204. In the example used in conjunction with FIG. 3, this would result in the selection of the value contained at location 210 of map 204.

Continuing with this example, if the map 204 represented a fuel per cylinder (FPC) value, the value would be selected from location 210 and used for the intended purposes. It should be understood that the arrangement represented in FIG. 3 is used in the present algorithms to select many different variables as a function of engine speed and operator demand. It should also be understood that the specific dimensions of the map 204 are not limiting on the present disclosure. For example, certain map matrices are n by n in dimension while others are m by m in dimension. Similarly, it is not a requirement of the present invention that the matrices be equal in its both dimensions. For example, certain data magnitudes may be more appropriately stored in an n by m matrix, while others are able to be stored in m by m matrices. The size and dimensions of each data map 204 are determined as a function of the required resolution needed to appropriately select the rows and columns of the map. For purposes of the following description, the representative matrices will be provided with a darkened entry, such as that identified by reference numeral 210 in FIG. 3, to represent the fact that only a single numeric variable is used from any particular map during any particular calculation.

The use of catalytic converters using oxidizing catalysts to remove CO and HC, and reducing catalysts to remove CO and $NO_x$, etc., or three-element catalysts, is known as method of cleansing exhaust gas emissions from internal combustion engines. These are mainly used in automobile engines. Because they have different regulatory requirements than automobile engines, non-catalyzed marine engines have the ability to run in lean-burn, during which the engine is operated at a fuel/air ratio that is less than stoichiometric (or an air/fuel ratio that is greater than stoichiometric). For a gasoline engine, the stoichiometric air/fuel ratio is 14.7:1. The stoichiometric air/fuel ratio is used to calculate a phi value ($\phi=AFR_{stoich}/AFR$), where $\phi=1$ when the air-fuel mixture is at stoichiometric. In contrast, when running in lean-burn, an engine's air-fuel mixture will have a target phi value that is less than 1, and in one non-limiting example is about 0.85. Lean burn operation is therefore at a target air/fuel ratio that is at least 14.8:1, and in one non-limiting example is about 17.3:1. Operating an engine in lean-burn can have a significant impact on improving fuel economy. However, the region in which an engine can operate efficiently in lean-burn is limited by the coefficient of variation (CoV) of combustion, emissions, torque availability, and drivability. The lean region can be further limited by altitude, engine coolant temperature, fuel system issues, and other engine faults. The potential gain in fuel economy from running in lean burn can be improved by using a binary on/off type of algorithm for initiating and ending lean-burn, and by undertaking changes in engine combustion parameters between operating in the stoichiometric region and operating in lean-burn separately of one another. This allows the lean-burn operating zone of the engine to be pushed to the edges of predetermined run quality, emissions, and efficiency limits.

Although the determinations of the ECM 48 about to be described herein below will be related to the fuel/air equivalence ratio $\phi$ (phi), it should be understood that the relative quantities of fuel and air in the combustion chamber 28 may also or instead be expressed in terms of the air/fuel equivalence ratio $\lambda$ (lambda), the air/fuel ratio (AFR), or the fuel/air ratio (FAR), depending on the programming of the ECM 48. These ratios are related to one another by way of simple mathematics and/or known stoichiometric values, and any of them can be easily determined using the reading from the oxygen sensor 71.

Figure 4A:
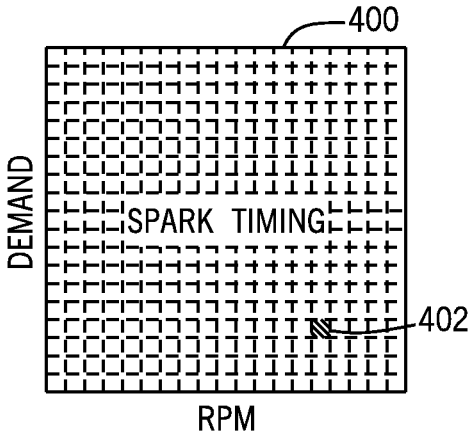
FIGS. 4A and 4B illustrate specific examples of input-output maps for determining timing of ignition of spark plugs of the engine.
Figure 4B:
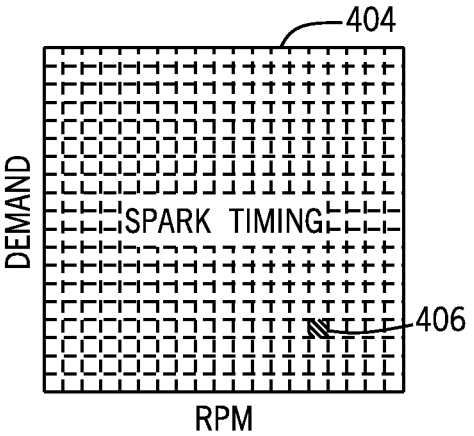
Figure 5A:
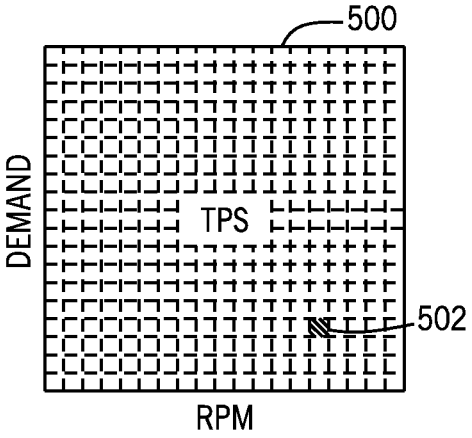
FIGS. 5A and 5B illustrate specific examples of input-output maps for determining air quantity in a combustion chamber of the engine.
Figure 5B:
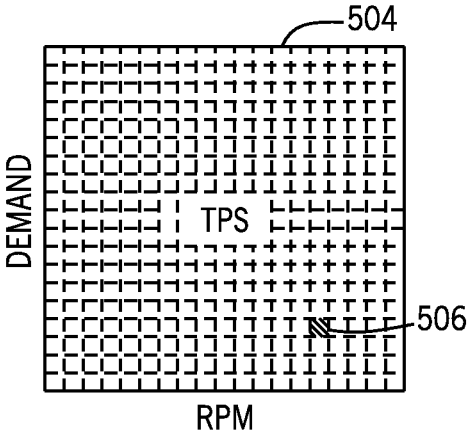
Figure 6A:
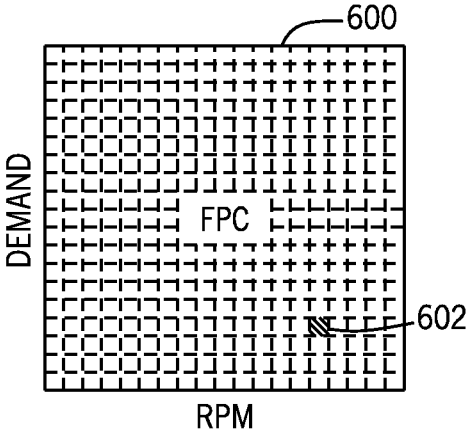
FIGS. 6A and 6B illustrate specific examples of input-output maps for determining fuel quantity in the engine's combustion chamber.
Figure 6B:
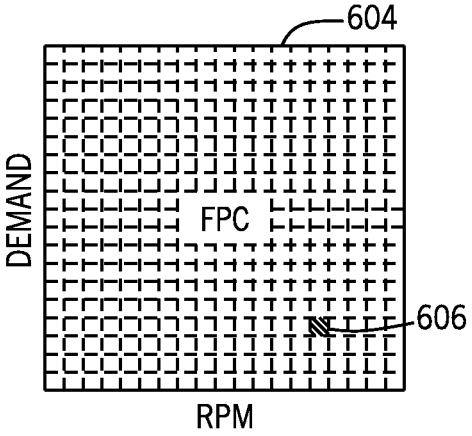

Referring to FIGS. 4A-6B, the present methods use separate sets of combustion parameter maps when the engine 10 is running in the stoichiometric region than when the engine 10 is running in lean burn. Separate stoichiometric and lean-burn combustion parameter maps are saved in the storage system 86 of the ECM 48 for each of three combustion parameters: a timing of activation of the spark-plug 24 associated with the combustion chamber 28, a quantity of fuel to be supplied to the combustion chamber 28 by way of fuel injector 40, and a quantity of air to be supplied to the combustion chamber 28 by way of throttle valve 14. For example, FIG. 4A shows a stoichiometric map for spark plug activation timing, while FIG. 4B shows a lean burn map or an offset map for spark plug activation timing; FIG. 5A shows a stoichiometric map for air quantity, while FIG. 5B shows a lean burn map or an offset map for air quantity; and FIG. 6A shows a stoichiometric map for fuel quantity, while FIG. 6B shows a lean burn map or an offset map for fuel quantity.

Figure 8:
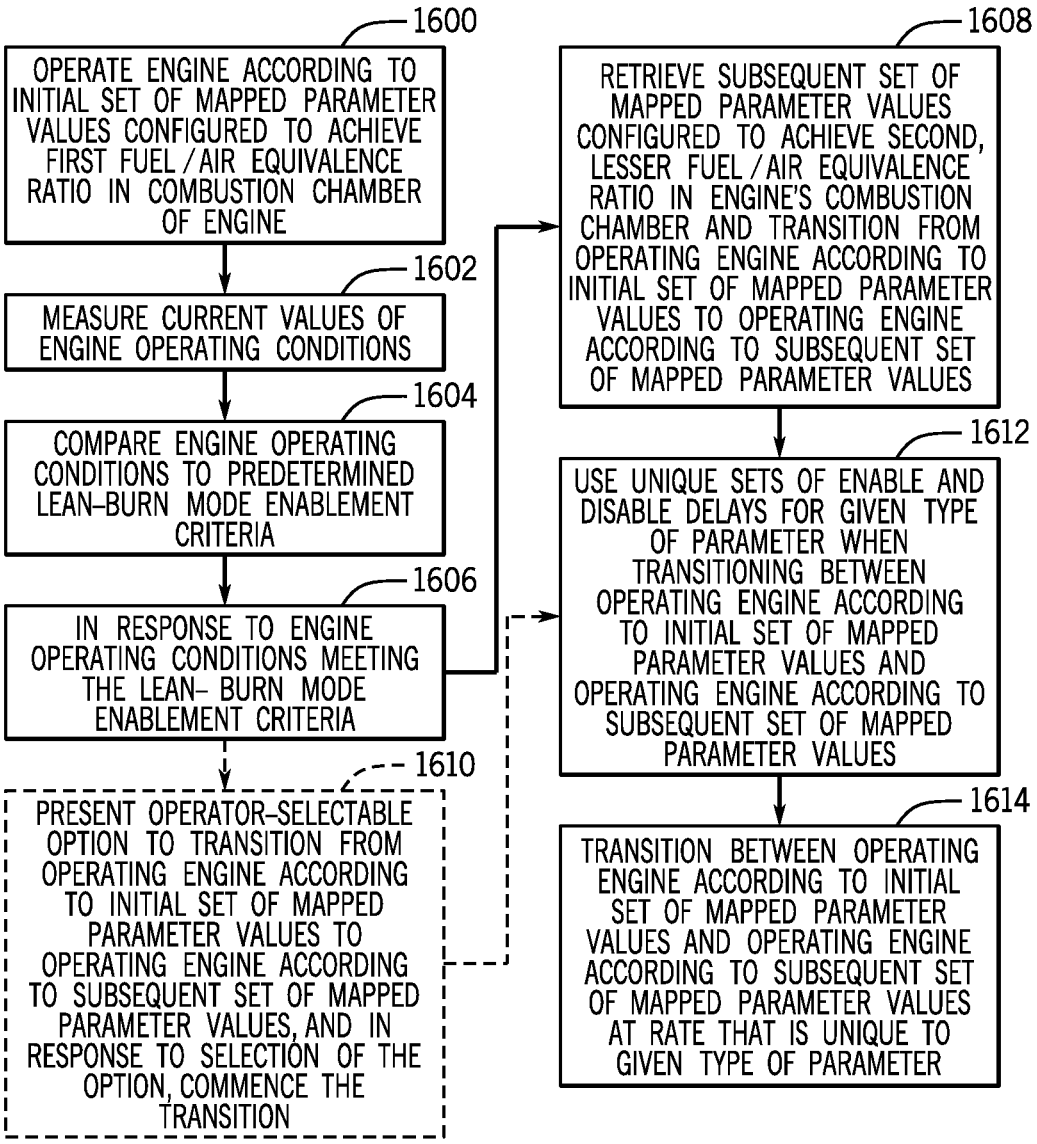
FIGS. 8-10 show various methods for transitioning between stoichiometric operation and lean-burn operation of the engine.

Turning now to FIG. 8, a method for controlling a marine internal combustion engine 10 will be described. The method is carried out by a control module (e.g., the ECM 48) and, as shown at 1600, includes operating the engine 10 according to an initial set of mapped parameter values configured to achieve a first fuel/air equivalence ratio in a combustion chamber 28 of the engine 10. As shown at 1602, the method includes measuring current values of engine operating conditions. For example, the ECM 48 may obtain information related to a barometric pressure of an atmosphere surrounding the engine 10 from the barometric pressure sensor 56 on line 58. As another example, the ECM 48 may obtain information relating to the temperature of the engine 10 from the temperature sensor 52 on line 50. Other engine operating conditions can also be measured and/or noted. Next, as shown at 1604, the method includes comparing the engine operating conditions to predetermined lean-burn enablement criteria. According to the present disclosure, the lean-burn enablement criteria may include one or more of the following: the engine 10 is running; the barometric pressure of the atmosphere surrounding the engine 10 is greater than a predetermined barometric pressure; the temperature of the engine 10 is greater than a predetermined temperature; and no active engine faults are present that would inhibit lean burn. In one example, the ECM 48 may store a list of predetermined engine faults that, if present, would inhibit lean burn, such as but not limited to: a barometric pressure range fault, a camshaft sensor fault, a crankshaft sensor fault, fuel injector faults, an intake air temperature sensor fault, a MAP sensor fault, an oxygen sensor fault, a coolant temperature sensor fault, or a throttle position sensor fault.

It should be understood that the algorithm may require that all or fewer than all of the lean-burn mode enablement criteria be met before the method will continue. Additional lean-burn mode enablement criteria may be used. For example, the lean-burn mode enablement criteria may also include that the engine is operating within an enablement zone as determined by a combination of a speed of the engine 10 and an operator demand, as will be described further herein below. As shown at 1606, the method also includes doing one of the following in response to the engine operating conditions meeting the lean-burn mode enablement criteria: (a) automatically retrieving a subsequent set of mapped parameter values configured to achieve a second, lesser fuel-air equivalence ratio in the engine's combustion chamber 28 and automatically transitioning from operating the engine 10 according to the initial set of mapped parameter values to operating the engine 10 according to the subsequent set of mapped parameter values (see 1608); and (b) presenting an operator-selectable option to transition from operating the engine according to the initial set of mapped parameter values to operating the engine according to the subsequent set of mapped parameter values, and in response to selection of the option, commencing the transition (see 1610). Which one of options (a) and (b) the ECM 48 uses could be programmed into the memory upon initial calibration, or could be a selectable function upon start-up of the engine 10. Alternatively, the ECM 48 might present the operator-selectable option for a given period of time after the lean-burn mode enablement criteria have been met, and after the given period of time has elapsed, may automatically transition into lean-burn mode.

In the example in which transitioning to the lean-burn mode is presented as an operator-selectable option (see 1610), a button, keypad, touchscreen, or similar located at the vessel's helm may be used to select such feature. For example, referring to FIG. 2, a screen 98, which is in communication with the ECM 48 via line 97, could display a message to the operator of the vessel asking if the operator would like to transition to lean-burn mode. Such a message could be accompanied by a colored light, flashing of the message, or an audible or haptic alert. Alternatively, no message may be presented, and a button 99 may instead light up or flash. The operator could then push the button 99, which could be a physically depressible key or a digital touch-screen button, in order to commence the transition into lean-burn mode. If the button 99 is not selected, the engine 10 would continue to operate in its current, non-lean-burn mode. Alternatively, a second button could be provided, which allows the operator to select not to enter lean-burn mode despite its availability. Subsequently, in response to the lean-burn mode conditions no longer being present, the screen 98 may similarly present the operator with an option to transition out of lean-burn mode. Alternatively, the ECM 48 may automatically transition out of lean-burn mode.

In one example of the method, the first fuel/air equivalence ratio is greater than or equal to 1 (i.e., the fuel/air ratio is at or above the stoichiometric fuel/air ratio for gasoline), although it should be understood that other fuel/air equivalence ratios could be used. The mapped parameter values in FIGS. 4A, 5A, and 6A would therefore respectively provide spark advance or retard information related to the spark plug timing, throttle position setpoint (TPS) information calibrated to achieve a given air quantity in the combustion chamber 28, and fuel per cylinder (FPC) information calibrated to achieve a given fuel quantity in the combustion chamber 28, which together result in the first fuel/air equivalence ratio. In one example, the second fuel/air equivalence ratio is less than 1 (i.e., the fuel/air ratio is less than stoichiometric), and is at or about $\phi=0.85$, although it should be understood that other fuel/air equivalence ratios could be used. The mapped parameter values in FIGS. 4B, 5B, and 6B would therefore respectively provide spark advance or retard information related to the spark plug timing, throttle position setpoint (TPS) information calibrated to achieve a given air quantity in the combustion chamber 28, and fuel per cylinder (FPC) information calibrated to achieve a given fuel quantity in the combustion chamber 28, which together result in the second fuel/air equivalence ratio. It should be understood that not only can the first and second fuel/air equivalence ratios be other than stoichiometric ($\phi=1$) and lean-burn ($\phi=0.85$), respectively, the first and second fuel/air equivalence ratios could also be reversed, such that the engine 10 transitions from operating at lean burn to operating at stoichiometric. Hereafter, some examples of the present disclosure will be described with respect to transitioning from stoichiometric operation to lean burn operation, but it should be understood that the same principles apply in general when transitioning from a first (or initial) fuel/air equivalence ratio to a second (or subsequent) fuel/air equivalence ratio.

Figure 9:
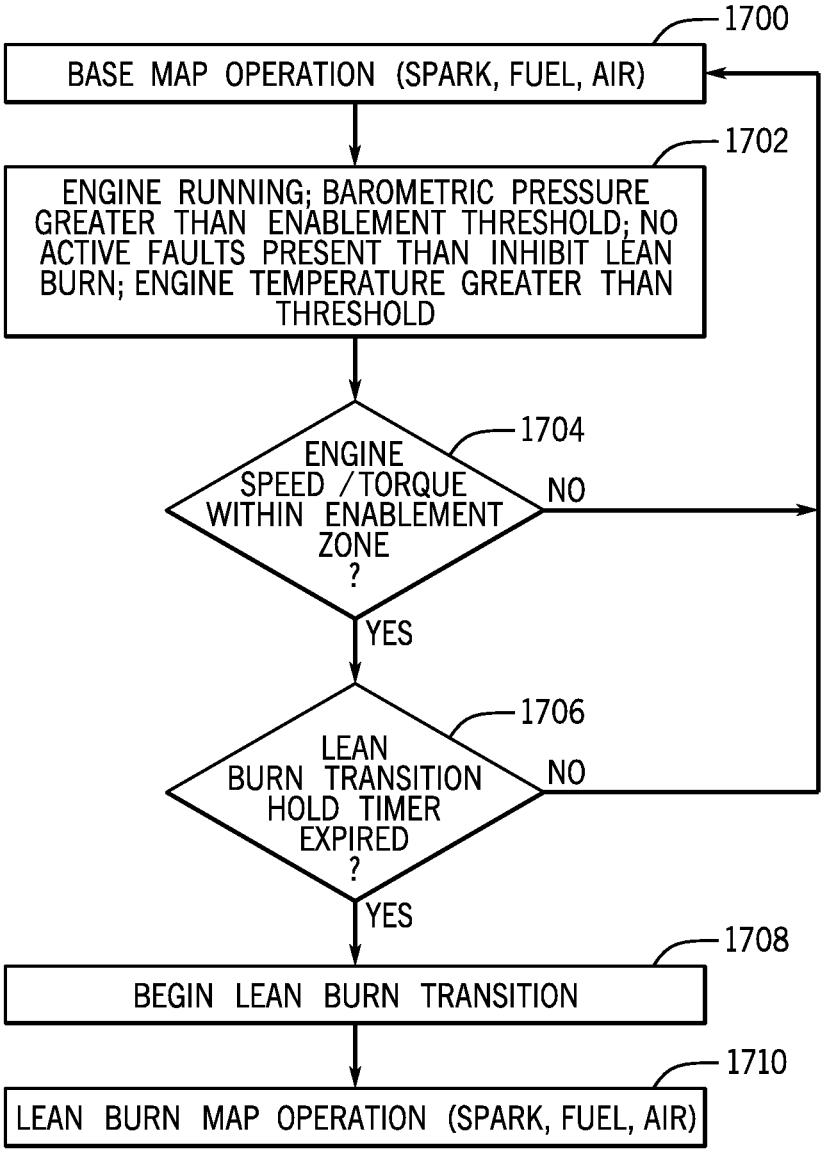

By way of specific example, as shown in FIG. 9, the engine 10 may start by operating according to base (stoichiometric) maps of parameter values for spark, fuel, and air, as shown at 1700. The ECM 48 may then conduct a lean-burn initial criteria check, as shown at 1702. As noted above, the ECM 48 may check if the engine 10 is running, the barometric pressure is greater than an enablement threshold, that no predetermined engine fault is present that would inhibit lean burn, and that the engine temperature is greater than an enablement threshold. Being able to disable lean-burn under certain conditions, such as at altitude (i.e., low barometric pressure), during cold drive-away, or if certain faults occur, allows a specifically controlled use of the lean burn feature. Once each of the conditions at 1702 is true, the ECM 48 will check if the engine speed and engine load are within a lean-burn enablement zone, as shown at 1704. Engine speed can be determined using the tachometer 46, while engine load can be determined using the readings from the throttle position sensor 62, throttle lever 54, and/or manifold pressure sensor 66. In general, the lean-burn enablement zone is within the middle range of engine operation, when the engine 10 is operating at or near midrange speeds and at midrange load (such as, for example, 50-70% of maximum rated speed/load, although other delimitations for what is considered "midrange" could used).

Figure 7:
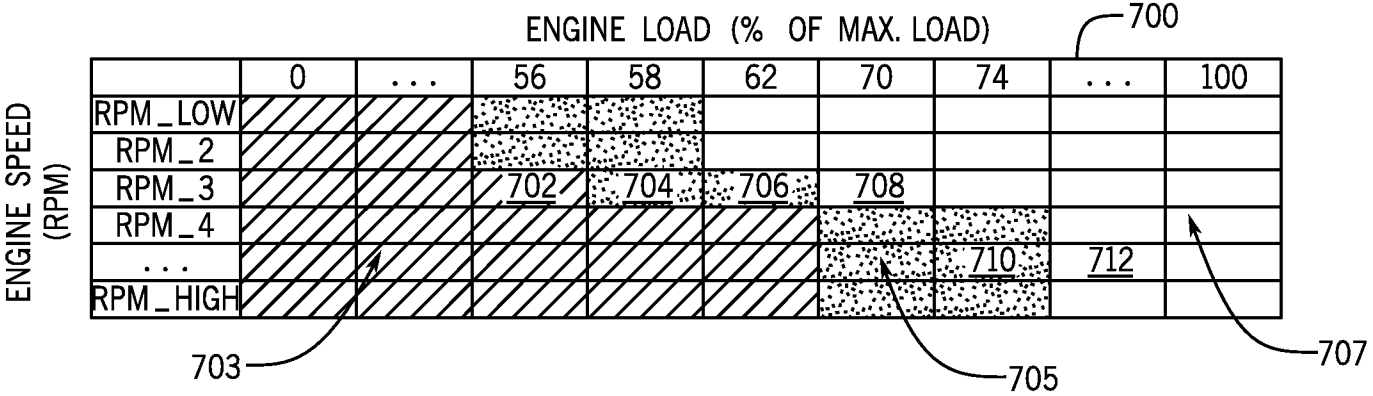
FIG. 7 illustrates an example of an input-output map identifying lower and upper engine speed thresholds and throttle valve position thresholds for operating the engine in a lean-burn mode.

FIG. 7 shows an exemplary input-output map 700 delineating the lean-burn enablement zone. In the example discussed below, engine load is determined by the position of the throttle lever 54, which corresponds to operator demand. Engine load (operator demand) is represented in the top row as ranging from 0% to 100% of maximum load. Several exemplary operator demand percentages are shown towards the center of map 700 for purposes of describing a lean-burn transition zone and a throttle position threshold. As shown in the left hand column, engine speed inputs range from RPM_LOW to RPM_HIGH. The RPM_LOW value represents a lower threshold below which lean-burn mode cannot be enabled, while the RPM_HIGH value represents an upper threshold above which the lean-burn mode cannot be enabled. These values therefore define the boundaries of the lean-burn enablement zone with respect to engine speed. In one example, RPM_LOW is about 2,100 RPM, although this value could range anywhere from 2,000 to 2,200 RPM. RPM_HIGH is about 5,800 RPM, although this value could range anywhere from 5,000 to 6,000 RPM.

The current engine speed, as determined by the tachometer 46, and the current operator demand, as determined from the throttle lever 54, are input to look up a throttle position setpoint in a corresponding cell of the input-output map 700. The lighter gray cells at the left hand side of the map 700 represent pairs of conditions at which the system is operating within the lean-burn enablement zone 703. For example, cell 702 holds a value for the throttle position setpoint corresponding to an engine speed of RPM_3 and an operator demand of 56%. Assuming that the other lean-burn enablement conditions noted hereinabove with respect to box 1702 of FIG. 9 are met, when the system is operating at the engine speed of RPM_3 and the operator demand of 56%, lean-burn can be enabled with the throttle position setpoint at this value.

Each of the darker gray cells at the middle of the map 700 represents a pair of conditions at which the system will transition into or out of the lean-burn mode. For example, cell 704 contains a throttle position setpoint for the engine speed of RPM_3 and an operator demand of 58%, and represents the lower limit of the transition zone 705. If the operator were to increase demand from 56% to 58% at engine speed RPM_3, the system would begin to transition out of the lean-burn mode according to the switch from cell 702 to cell 704. Cell 706 corresponds to the engine speed of RPM_3 and an operator demand of 62%, and represents the upper limit of the transition zone 705. As operator demand increases from 58% to 62%, the algorithm ramps out the throttle position setpoint from the value in cell 704 to the value in cell 706, as will be described herein below with respect to FIG. 10.

The white cells at the right hand side of the map 700 represent pairs of conditions at which lean-burn cannot be enabled. Cell 708, corresponding to the engine speed of RPM_3 and an operator demand of 70%, is within this non-enablement zone 707. Thus, a throttle position threshold is defined between the transition zone 705 and the non-enablement zone 707, above which throttle position threshold lean-burn cannot be enabled. The cells in the non-enablement zone 707 hold throttle position setpoints that exceed the throttle position threshold. As suggested by the stepped shape of the transition zone 705, the throttle position threshold varies with engine speed. In other words, the throttle position threshold between cells 706 and 708 is different than the throttle position threshold between cells 710 and 712.

Each of the engine speed, operator demand, and corresponding throttle position setpoint and threshold values in input-output map 700 can be calibrated for a specific vessel application. Note that values between those shown can be interpolated. Additionally, while the above example described engine load (operator demand) increasing while engine speed remained constant, in other examples, engine speed could increase with increasing operator demand, although there could be a lag between the two. It should be understood that the input-output map 700 can also be used to initiate a transition from the non-enablement zone 707, through the transition zone 705, and into the lean-burn enablement zone 703, although the example above described a transition in the opposite direction.

Returning to FIG. 9, if the condition at 1704 is not true, i.e., if the engine speed and engine load are not within the lean-burn enablement zone 703, the algorithm returns to 1700. If the engine 10 is operating within the lean-burn enablement zone 703 as determined at 1704, the ECM 48 next checks if a lean burn transition hold timer has expired, as shown at 1706. Utilizing the timer ensures that the engine 10 is not in a transient state, which would result in lean burn enabling and disabling more frequently than desired. If no, or if any of the other enablement conditions fails during the duration of the timer, the method returns to 1700. If yes, the ECM 48 begins the transition to lean burn, as shown at 1708. The ECM 48 transitions to using unique lean burn maps for operation of the engine 10, as shown at 1710.

According to the present disclosure, the stoichiometric set of mapped parameter values is contained in a first input-output map that is unique from a second input-output map containing the lean-burn set of mapped parameter values, both of which are saved in the storage system 86. That is, the map 400 shown in FIG. 4A is unique from the map 404 shown in FIG. 4B; the map 500 shown in FIG. 5A is unique from the map 504 shown in FIG. 5B; and the map 600 shown in FIG. 6A is unique from the map 604 shown in FIG. 6B. Regardless of whether the ECM 48 makes the lean-burn mode transition automatically (see 1608) or in response to operator selection of the option to transition (see 1610), according to the present example, the ECM 48 uses unique sets of enable and disable delays for a given type of parameter (i.e., spark, fuel, or air) when transitioning between operating the engine 10 according to the initial set of mapped parameter values (found in maps 400, 500, 600) and operating the engine 10 according to the subsequent set of mapped parameter values (found in maps 404, 504, 604). The ECM 48 also transitions between operating the engine 10 according to the initial set of mapped parameter values and operating the engine 10 according to the subsequent set of mapped parameter values at a rate that is unique to the given type of parameter. These steps are shown at 1612 and 1614 of FIG. 8, respectively.

Note that the same lean-burn enablement criteria noted at 1702 and 1704 being untrue will disable lean burn at any time during or after a transition into lean burn. Therefore, the present example also includes transitioning from operating the engine 10 according to the lean-burn set of mapped parameter values to operating the engine 10 according to the stoichiometric set of mapped parameter values in response to one or more of the engine operating conditions no longer meeting one or more of the respective lean-burn mode enablement criteria. In fact, both during the transition and while operating in lean-burn, the ECM 48 will regularly or continuously check the lean-burn enablement criteria by comparing them to measured current values of engine operating conditions. If any of the lean-burn enablement criteria becomes untrue, lean burn transition or operation is terminated, and the ECM 48 returns the system to operating in maps 400, 500, and 600 using unique disable delays and ramps, as will be described below.

Figure 10:
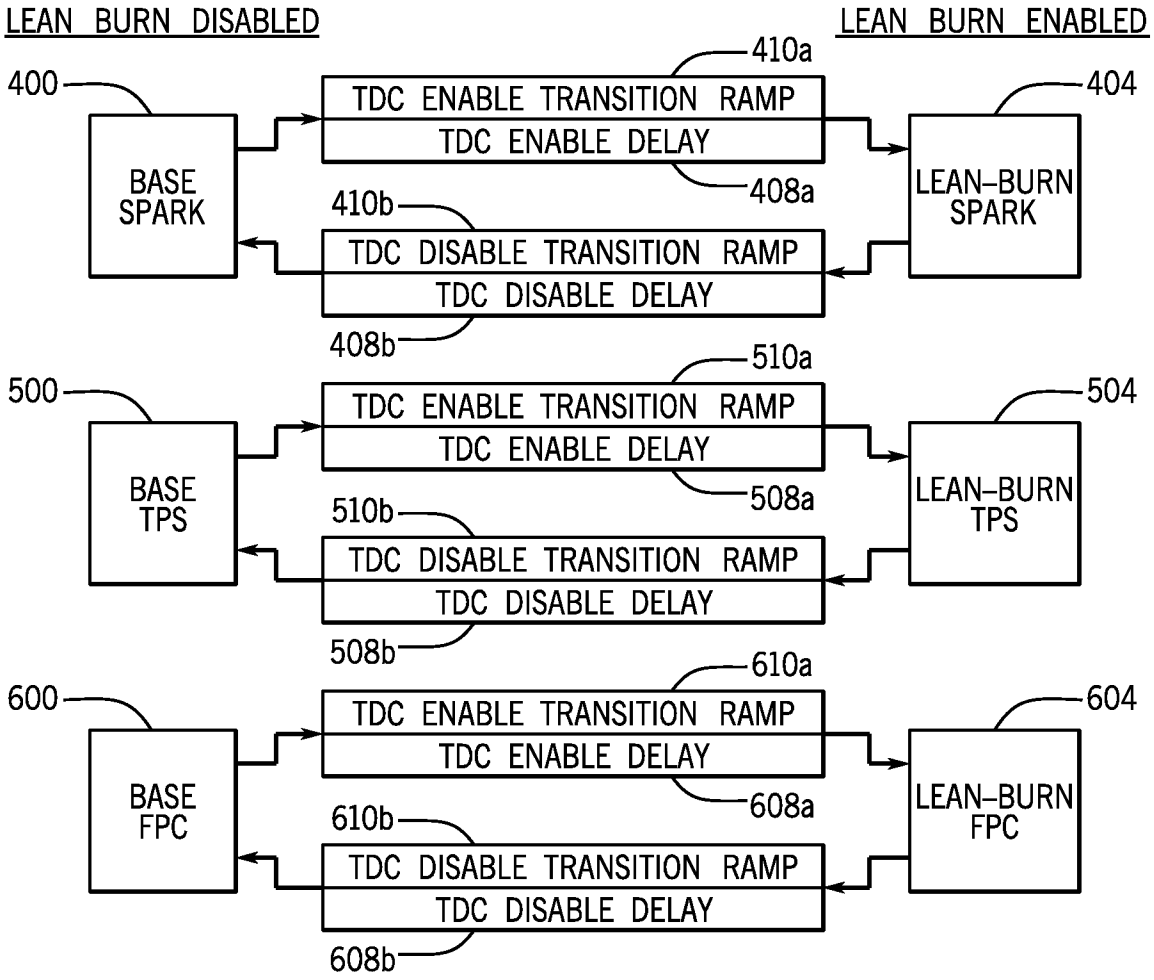

The above-noted concepts are shown generally in FIG. 10, where base spark, air, and fuel maps 400, 500, 600 are shown on the left-hand side as being used when lean-burn is disabled, and lean-burn spark, air, and fuel maps 404, 504, 604 are shown on the right-hand side as being used when lean-burn is enabled. To transition between the two sets of mapped parameter values, the ECM 48 uses unique enable/disable delays. The ECM 48 uses a first set of enable and disable delays 408*a*, 408*b* when transitioning between operating the engine 10 according to spark plug activation timing data in the initial set of mapped parameter values from map 400 and operating the engine 10 according to spark plug activation timing data in the subsequent set of mapped parameter values from map 404. The ECM 48 utilizes a second set of enable and disable delays 508*a*, 508*b* when transitioning between operating the engine 10 according to the air quantity data in the initial set of mapped parameter values from map 500 and operating the engine 10 according to the air quantity data in the subsequent set of mapped parameter values from map 504. The ECM 48 utilizes a third set of enable and disable delays 608*a*, 608*b* when transitioning between operating the engine 10 according to the fuel quantity data in the initial set of mapped parameter values from map 600 and operating the engine 10 according to the fuel quantity data in the subsequent set of mapped parameter values from map 604. These unique delays essentially mean that the spark plug activation timing, fuel quantity, and air quantity can be changed separately from one another during the transition period. This allows for a torque neutral transition, as will be described further herein below, because each of these combustion parameters affects torque output in a different manner, one taking longer than the others, one having a more instantaneous affect than the others, and one having a non-linear effect on torque. Controlling when the base/lean-burn maps transition with respect to one another, as well as the rate at which transitions are made from a base map to a lean-burn map and vice versa, provides a seamless transition into and out of lean burn.

Because the combustion parameters are each scheduled to change during the enable or disable transition period, and because each parameter starts and ends at a unique value, each parameter also has a unique set of enable and disable rates. Continuing with reference to FIG. 10, the ECM 48 transitions at a first rate 410*a* between operating the engine 10 according to spark plug activation timing data in the initial set of mapped parameter values from map 400 and operating the engine according to spark plug activation timing data in the subsequent set of mapped parameter values from map 404. The transition out of lean burn may occur at a rate 410*b*, which may be the same as or different from the first rate 410*a*. The ECM 48 transitions at a second rate 510*a* between operating the engine 10 according to the air quantity data in the initial set of mapped parameter values from map 500 and operating the engine 10 according to the air quantity data in the subsequent set of mapped parameter values from map 504. The transition out of lean burn may occur at a rate 510*b*, which may be the same as or different from the second rate 510*a*. The ECM 48 also transitions at a third rate 610*a* between operating the engine 10 according to the fuel quantity data in the initial set of mapped parameter values from map 600 and operating the engine 10 according to the fuel quantity data in the subsequent set of mapped parameter values 604. The transition out of lean burn may occur at a rate 610*b*, which may be the same as or different from the third rate 610*a*. These unique rates can be expressed as linear lengths of time, as being with respect to TDCs, or as desired slopes/ramps to be used for transitioning from one combustion parameter value to another.

In one example, the subsequent set of mapped parameter values comprises offset values to be added to the initial set of mapped parameter values or by which the initial set of mapped parameters is to be multiplied. That is, the maps 404, 504, 604 may contain offset values or multipliers to be added to or multiplied with a corresponding value from the base maps 400, 500, 600, which offset values or multipliers change the stoichiometric values from the base maps 400, 500, 600 into lean-burn values.

Note that each transition between a base map and a lean burn map (or between the base map and the base-map-plus-offset map) occurs between corresponding values in each map. That is, when transitioning from using base map 400 to lean-burn map 404, the ECM 48 will transition from using a spark timing value found at location 402 to using a spark timing value found at corresponding location 406. Before the transition, other engine speeds and operator demands might command values of spark timing from other cell locations, but once a decision to transition has been made, the current value at location 402 is used as the starting value for the transition. After the transition to the value at location 406 is completed, other engine speeds and operator demands might thereafter command values of spark timing from other cell locations. The same principle holds true for transitions between the maps for the other combustion parameters, where the exemplary current values at locations 502 and 602 are used as the starting points for transition, and the exemplary target values at locations 506 and 606 are used as the ending points. Thus, the present method includes transitioning from operating the engine 10 according to a current value of a given combustion parameter determined from the initial set of mapped parameter values to operating the engine 10 according to a target value of the given combustion parameter determined from the subsequent set of mapped parameter values.

The above-mentioned unique transition rates bring about gradual transitions from the current value of a given combustion parameter to the target value of a given combustion parameter, and may be accomplished in several ways. For example, the given combustion parameter may transition from a current value to a target value over 10 seconds or over a given number of TDCs. The changes can be smooth, such as at a rate of X units per second, or can be done in a step-wise manner, so long as the steps do not result in noticeable changes in engine performance. In general, the transition is designed to be smooth enough that the operator cannot hear or feel any changes in engine performance.

As noted above with respect to FIG. 10, transitions into and out of lean-burn operation occur at unique rates depending on the combustion parameter in question. Thus, the overall transition into and out of lean-burn operation occurs gradually, i.e., over a non-zero period of time. This allows the ECM 48 to ramp in and ramp out the changes in spark plug activation timing, fuel quantity, and air quantity, such that the operator of the marine vessel does not hear or feel any changes in engine performance. However, if the operator very quickly moves the throttle lever 54 by more than a calibratable limit, instead of using the disable delays and ramps, the ECM 48 will instantaneously return to operating in base maps 400, 500, and 600. When the operator advances the throttle lever 54 very quickly, the transition out of lean-burn—required either because the engine speed dropped below RPM_LOW or rose above RPM_HIGH, or because the throttle position threshold was exceeded (see FIG. 7)—cannot be undertaken gradually because the operator has requested an amount of torque that the lean-burn maps 404, 504, 604 are incapable of providing. Under such conditions, the ECM 48 will ignore any ramp-out scheduling of the combustion parameters and will instead immediately begin operating according to the base maps 400, 500, and 600 for each combustion parameter. Because the operator has already requested a rapid increase or decrease in torque via the throttle lever 54, any torque fluctuations caused by abandoning the ramped, gradual transition are masked.

Figure 11:
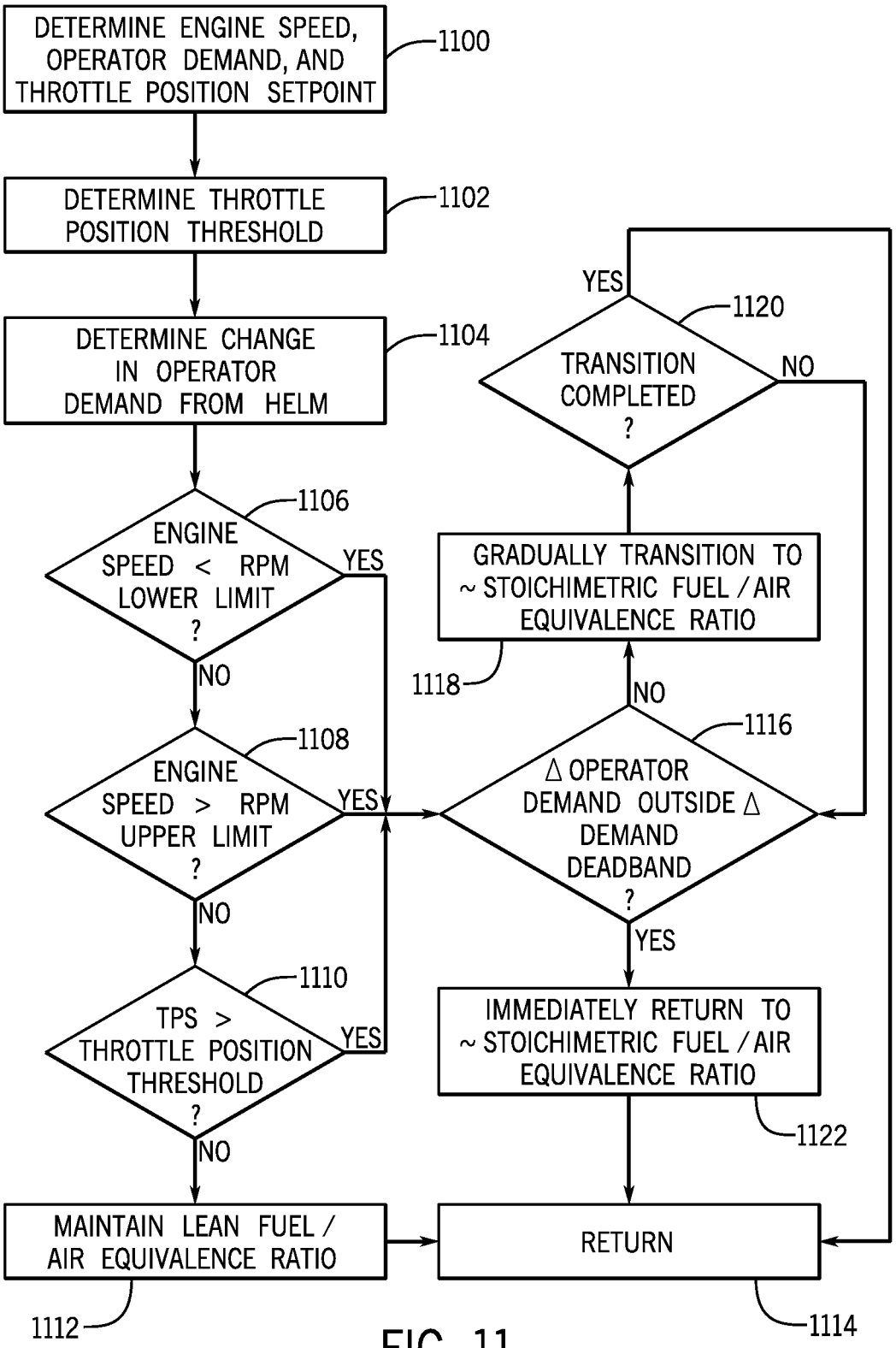
FIG. 11 illustrates a method according to the present disclosure for determining whether and how to transition between stoichiometric operation and lean-burn operation of the engine.

FIG. 11 illustrates an example of an algorithm that the ECM 48 may carry out according to the present method. The algorithm is begun once the system is operating in the lean-burn mode using lean-burn maps 404, 504, and 604 to determine the combustion parameters. As shown at box 1100, the method includes determining the engine speed, the operator demand, and the throttle position setpoint. The engine speed can be measured using the tachometer 46, as noted above. The operator demand is input via the throttle lever 54. The ECM 48 determines the throttle position setpoint based on the operator demand from the throttle lever 54 and other information relating to the operation of the engine 10, as described hereinabove with respect to FIGS. 2, 5A, and 5B. As shown at box 1102, the method also includes determining the throttle position threshold beyond which lean-burn cannot be enabled. The throttle position threshold can be determined based on the current engine speed, such as described with respect to the input-output map 700 shown in FIG. 7.

The method also includes determining a change in operator demand from the helm, as shown at box 1104. Note that this includes an operator demand input via a remote control or a remote helm. The ECM 48 may determine the change in operator demand by comparing a current operator demand from the throttle lever 54 with a filtered operator demand, wherein the change in operator demand is calculated as the difference between the current demand and the filtered demand. Applying a filter to the operator demand filters out noise in the signal from the throttle lever 54 and allows changes in operator demand to be caught as they occur. The filter may be a type of moving average filter, which averages the current operator demand value and a predetermined number of past operator demand values. In one example, the filter applied is a first order exponential filter. The first order exponential filter operates according to the equation: $y(k)=a*y(k-1)+(1-a)*x(k)$, where $x(k)$ is the raw input at time step k; $y(k)$ is the filtered output at time step k; and "a" is a constant between 0 and 1. In one example, $a=\exp(-T/\tau)$, where $\tau$ is the filter time constant, and T is a fixed time step between samples.

As shown at decision 1106, the ECM 48 next determines whether the actual engine speed, measured in box 1100, is less than the RPM lower limit. The RPM lower limit is a calibrated value, and an example lower limit RPM_LOW is described hereinabove with respect to FIG. 7. If no, the method continues to decision 1108, where the ECM 48 determines if the engine speed is greater than an RPM upper limit. An example upper limit RPM_HIGH is also shown and described with respect to FIG. 7. If no, the method continues to decision 1110, where the ECM 48 determines if the throttle position setpoint, determined at box 1100, is greater than the throttle position threshold, determined at box 1102. If the answer is no at decision 1110, the method continues to box 1112, and the ECM 48 maintains operation in the lean-burn mode at the lean fuel-air equivalence ratio because the operating conditions are still within the lean-burn enablement zone 703 (FIG. 7). The method thereafter continues to box 1114, where it returns to box 1100 for the next iteration. Note that the decisions at 1106, 1108, and 1110 do not need to be made in the order shown, nor are they required to follow boxes 1100, 1102, and 1104. Rather, these steps could be performed in different orders or in some instances simultaneously.

If any of the decisions at boxes 1106, 1108, or 1110 is yes, then the system can no longer operate in the lean-burn mode because the operating conditions are not within the lean-burn enablement zone 703 described hereinabove with respect to FIG. 7. However, disabling the lean-burn mode can be done gradually or abruptly depending on the change in operator demand. Thus, the method next continues to decision 1116, where the ECM 48 determines if the change in operator demand, determined at box 1104, is outside a delta demand deadband. The delta demand deadband is a predetermined deadband having a positive upper limit and a negative lower limit, which indicate the changes in operator demand above and below which the lean-burn combustion parameter maps cannot achieve the torque requested by the operator. The upper and lower limits of the delta demand deadband are calibratable and may depend on the particular vessel application.

If the decision at 1116 is no, the method continues to box 1118, and the ECM 48 gradually transitions from using the lean-burn maps 404, 504, 604 to using the base maps 400, 500, 600, which as noted hereinabove are configured to achieve more or less of a stoichiometric fuel-air equivalence ratio in the engine's combustion chamber(s) 28. The ECM 48 uses the ramps and delays described hereinabove with respect to FIG. 10 to achieve such a gradual transition. The method thereafter continues to decision 1120, where the ECM 48 determines if the transition to the base maps has completed. If yes, the method continues to box 1114 and thereafter returns to start. If no, the method returns to decision 1116, where it is again determined whether the change in operator demand is outside the delta demand deadband. This recurring determination allows the EMC 48 to catch any changes in operator demand outside the delta demand deadband that occur after a gradual transition back to the base maps has already begun.

If the decision at 1116 is yes, either before or after a transition back to the base maps has begun, the method continues to box 1122, and the ECM 48 immediately returns to operating the engine 10 with a more or less stoichiometric fuel-air equivalence ratio by using the base maps. In such an instance, the ECM 48 has determined that the engine 10 is not capable of providing the torque requested by the operator using the lean-burn maps 404, 504, 604, and must instead abruptly return to using the base maps 400, 500, 600. The method thereafter continues to box 1114 and returns to start.

Thus, if lean-burn operation was already beginning to be ramped out according to box 1118, but then the change in operator demand exceeded the delta demand deadband (decision 1116), the system will immediately be reset to using the base maps. Even if the system had not yet begun to ramp out the lean-burn combustion parameters, if the change in operator demand is outside the delta demand deadband, the system will nonetheless immediately bail directly back to using the base maps so long as the engine speed is outside of an engine speed deadband defined between the lower and upper RPM thresholds (e.g., RPM_LOW and RPM_HIGH), and/or the throttle position setpoint exceeds the throttle position threshold.

Figure 12:
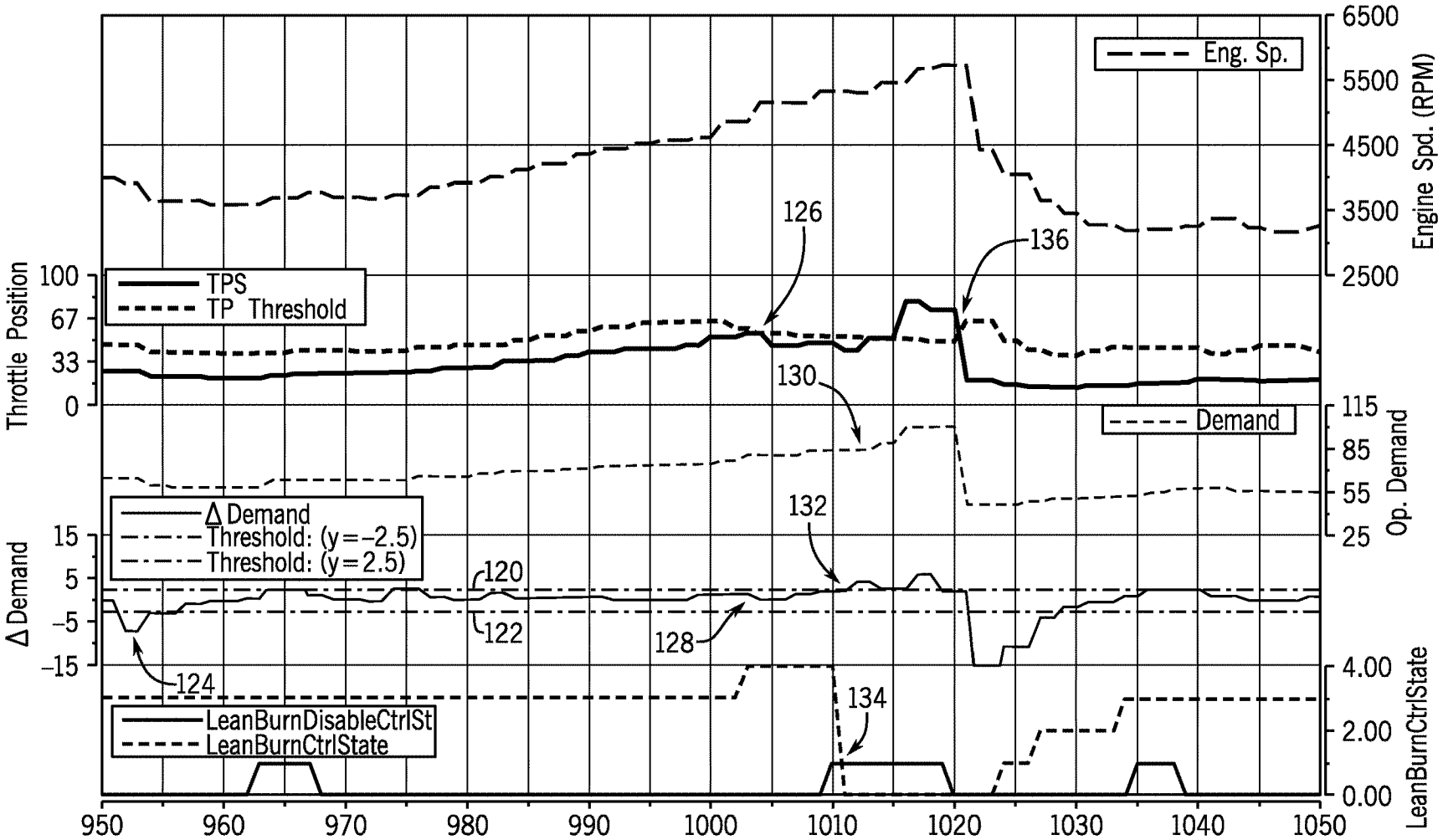
FIG. 12 shows a plot of various propulsion system parameters and control states over time as the engine control system transitions between stoichiometric operation and lean-burn operation of the engine.

An example of this method being run on a vessel is provided in FIG. 12. The top plot in FIG. 12 shows the engine speed in RPM, while the second from top plot shows the throttle position setpoint (TPS) and the throttle position threshold compared to one another. The middle plot shows the operator demand from the throttle lever 54. The second from bottom plot shows the change in operator demand vis-a-vis the delta demand deadband, with an upper limit as indicated at 120 and a lower limit as indicated at 122. Note that these deadband limits 120, 122 are merely exemplary and that the values shown herein are not limiting on the scope of the present disclosure. The lean-burn control state and the lean-burn disable control state are shown on the bottom plot.

As shown at 124, at about 952 seconds, the change in operator demand is outside the delta demand deadband defined between lower limit 122 and upper limit 120. However, because neither the engine speed is outside of the deadband between the upper RPM limit and the lower RPM limit, nor does the throttle position setpoint exceed the throttle position threshold, the system is allowed to continue to operate in lean-burn mode, as shown by the lean-burn control state remaining at 3 (enabled). As time continues, the throttle position threshold varies as the engine speed also varies. This is according to the calibrated threshold values in the input-output map 700 shown in FIG. 7. At about 1003 seconds, as shown at 126, the throttle position setpoint exceeds the throttle position threshold. At this time, the change in operator demand is still within the deadband between 120 and 122, as shown at 128. However, because the throttle position threshold as been exceeded, the lean-burn control state switches to 4, and the ECM 48 begins to ramp out the lean-burn combustion parameters. Thereafter, the throttle lever 54 is continually advanced, as shown by the increasing operator demand at 130. At about 1011 seconds, as shown at 132, the change in operator demand exceeds the upper limit 120, i.e. is outside of the deadband. As shown at 134, the lean-burn disable state therefore switches to 1 (true) and the lean-burn control state immediately switches to 0 (disabled) in view of the fact that both the throttle position threshold has been exceeded and the change in operator demand has crossed outside the deadband. The system then operates according to combustion parameters from the base maps, until as shown at 136, the throttle position setpoint dips below the throttle position threshold. When this occurs, the lean-burn control state changes to 1 (delay) and thereafter to 2 (ramp-in), and the system thereafter operates in lean-burn.

Figure 13:
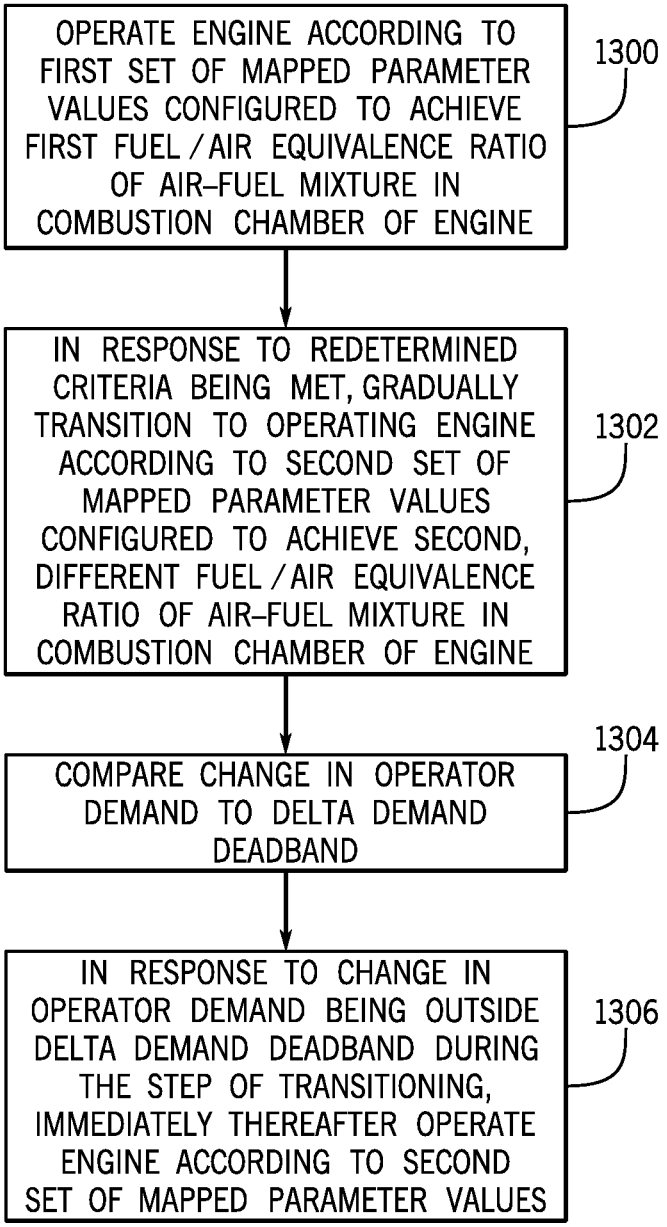
FIGS. 13-15 show methods according to the present disclosure for abruptly ending lean-burn operation of the engine.

FIG. 13 illustrates another method for controlling a marine internal combustion engine 10 according to the present disclosure. The method is carried out by a control module (ECM 48) and includes operating the engine 10 according to a first set of mapped parameters values configured to achieve a first fuel/air equivalence ratio of an air-fuel mixture in a combustion chamber 28 of the engine 10, as shown at box 1300. As shown at box 1302, in response to predetermined criteria being met, the method includes gradually transitioning to operating the engine 10 according to a second set of mapped parameter values configured to achieve a second, different fuel/air equivalence ratio of the air-fuel mixture in the combustion chamber 28. The method may include comparing the speed of the engine 10 to an engine speed deadband and comparing a throttle position setpoint to a throttle position threshold. In one example, the predetermined criteria comprise at least one of: (i) the engine speed is outside the engine speed deadband, and (ii) the throttle position setpoint exceeds the throttle position threshold. As shown at box 1304, the method also includes comparing a change in operator demand to a delta demand deadband. As shown at box 1306, in response to the change in operator demand being outside the delta demand deadband during the step of transitioning, the method may include immediately thereafter operating the engine 10 according to the second set of mapped parameter values.

As noted hereinabove, the first and second sets of mapped parameters values correspond to at least one of the following combustion parameters: a timing of activation of a spark plug associated with the combustion chamber 28, the quantity of air to be supplied to the combustion chamber 28, and a quantity of fuel to be supplied to the combustion chamber 28. In one example, the first fuel/air equivalence ratio is less than 1, corresponding to operation in the lean-burn mode. In one example, the second fuel-air equivalence ratio is at least 1, corresponding to operation at the stoichiometric fuel/air equivalence ratio.

The step of gradually transitioning to operating the engine 10 according to the second set of mapped parameter values may include transitioning from operating the engine 10 according to an initial value of a given combustion parameter determined from the first set of mapped parameter values to operating the engine 10 according to a target value of the given combustion parameter determined from the second set of combustion parameters at a non-zero rate that is unique to the given combustion parameter. Additionally, the step of gradually transitioning to operating the engine 10 according to the second set of mapped parameter values may include transitioning from operating the engine 10 according to an initial value of a given combustion parameter determined from the first set of mapped parameter values to operating the engine 10 according to a target value of the given combustion parameter determined from the second set of combustion parameters utilizing a delay that is unique to the given combustion parameter. Such methods were described hereinabove with respect to FIG. 10.

Figure 14:
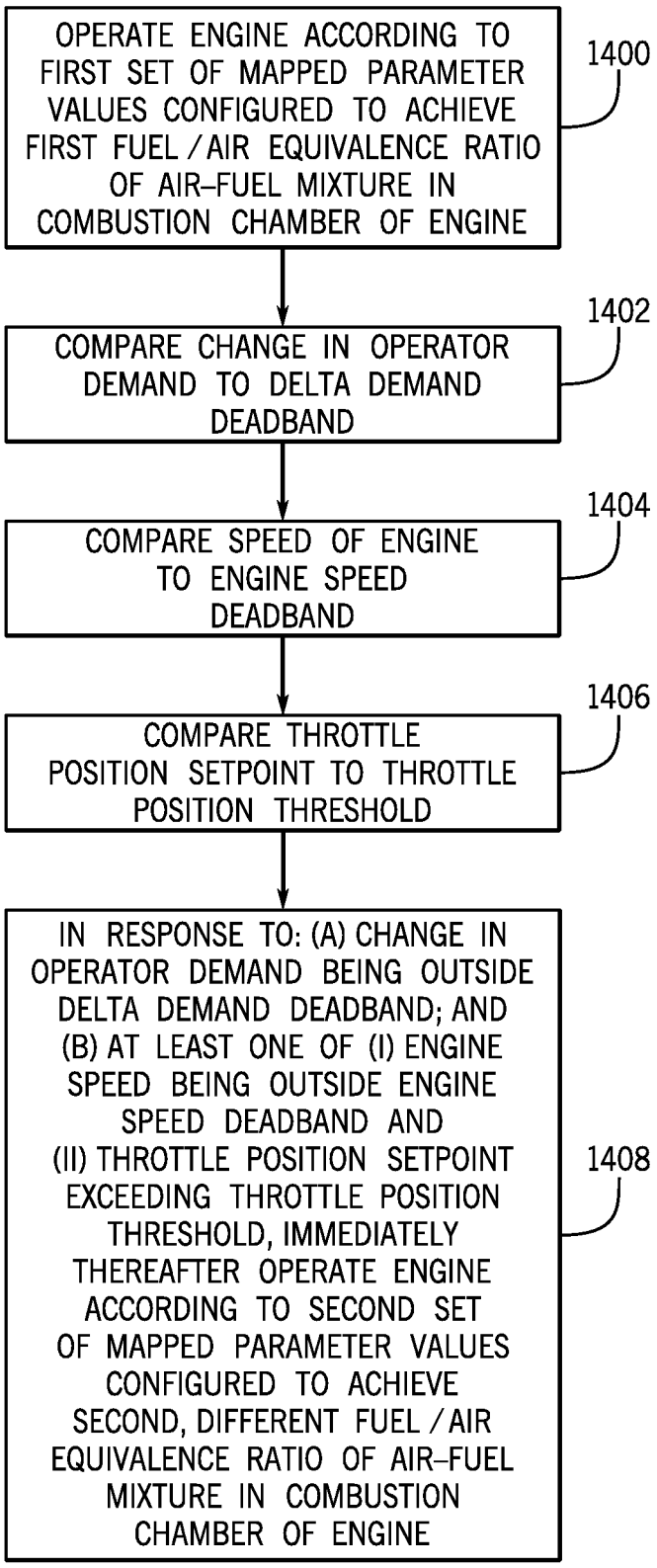

FIG. 14 illustrates another method for controlling a marine internal combustion engine 10. The method is carried out by a control module (ECM 48) and, as shown at box 1400, includes operating the engine 10 according to a first set of mapped parameter values configured to achieve a first fuel/air equivalence of an air-fuel mixture in a combustion chamber 28 of the engine 10. As shown at box 1402, the method includes comparing a change in operator demand to a delta demand deadband. This step may include comparing a current operator demand with a filtered operator demand. The method may also include comparing a speed of the engine 10 to an engine speed deadband, as shown at box 1404, and comparing a throttle position setpoint to a throttle position threshold, as shown at box 1406. Step 1406 may include determining the throttle position threshold based on the engine speed.

As shown at box 1408, in response to: (a) the change in operator demand being outside the delta demand deadband, and (b) at least one of: (i) the engine speed being outside the engine speed deadband, and (ii) the throttle position setpoint exceeding the throttle position threshold, the method includes immediately thereafter operating the engine 10 according to a second set of mapped parameter values configured to achieve a second, different fuel/air equivalence ratio of the air-fuel mixture in the combustion chamber 28. This portion of the method was described in more detail with respect to decision 1116 and box 1122 of FIG. 11. In one example, the first fuel-air equivalence ratio is less than the second fuel-air equivalence ratio. In one example, the first fuel/air equivalence ratio is less than 1, and the second fuel-air equivalence ratio is at least 1.

The method may further include gradually transitioning to operating the engine 10 according to the second set of mapped parameter values in response to: (a) the change in operator demand being inside the delta demand deadband, and (b) at least one of: (i) the engine speed being outside the engine speed deadband, and (ii) the throttle position setpoint exceeding the throttle position threshold. In other words, so long as the change in operator demand is inside the delta demand deadband, the system can gradually transition out of the lean-burn mode, as described with respect to decision 1116 and box 1118 of FIG. 11.

Figure 15:
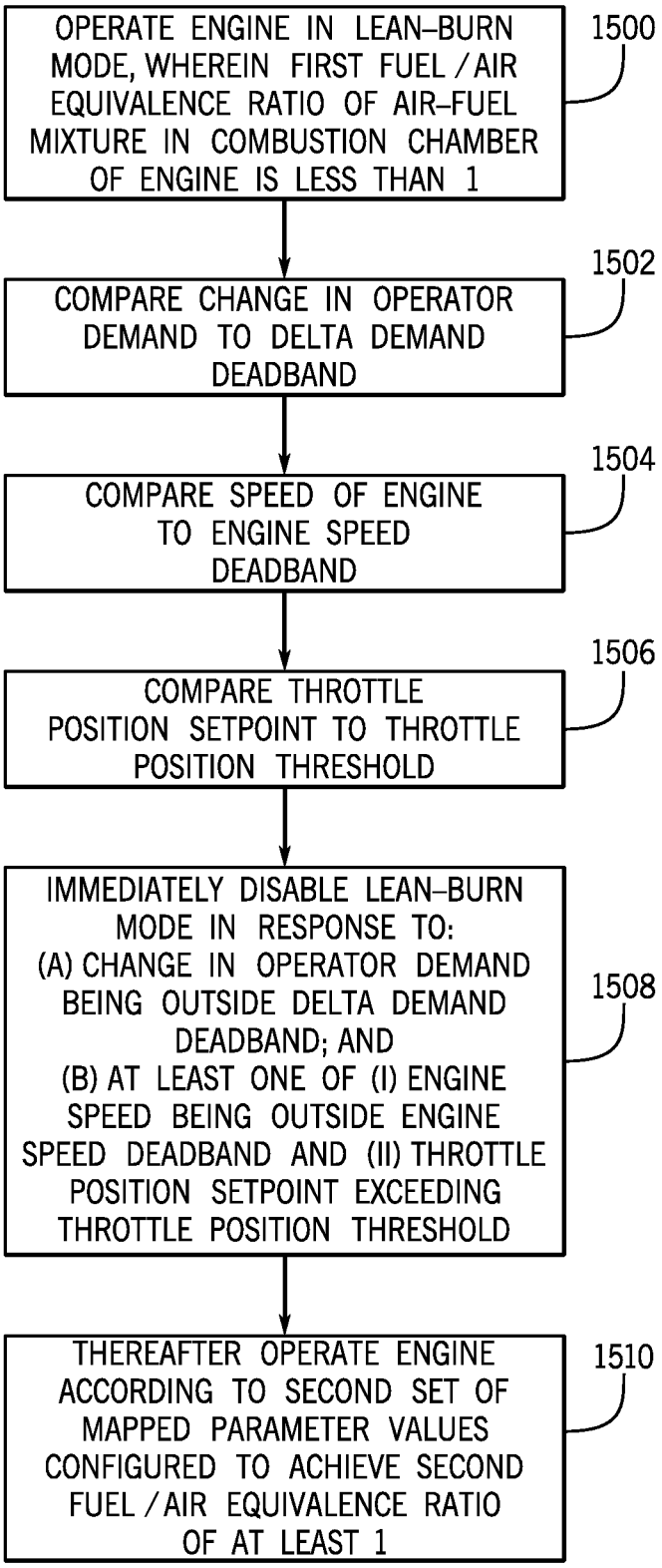

FIG. 15 illustrates yet another method for controlling a marine internal combustion engine 10 according to the present disclosure, the method being carried out by a control module (ECM 48). As shown at box 1500, the method includes operating the engine 10 in a lean-burn mode, wherein a first fuel/air equivalence ratio of an air-fuel mixture in a combustion chamber 28 of the engine 10 is less than 1. As shown at box 1502, the method includes comparing a change in operator demand to a delta demand deadband. As shown at box 1504, the method includes comparing a speed of the engine 10 to engine speed deadband. As shown at box 1506, the method includes comparing a throttle position setpoint to a throttle position threshold. As shown at box 1508, the method thereafter includes immediately disabling the lean-burn mode in response to: (a) the change in operator demand being outside the delta demand deadband, and (b) at least one of: (i) the engine speed being outside the engine speed deadband, and (ii) the throttle position setpoint exceeding the throttle position threshold. As shown at box 1510, the method thereafter includes operating the engine 10 according to a second set of mapped parameter values configured to achieve a second fuel-air equivalence ratio of at least 1. See decision 1116 and box 1122 of FIG. 11.

The method may further include gradually transitioning out of the lean-burn mode in response to: (a) the change in operator demand being inside the delta demand deadband, and (b) at least one of: (i) the engine speed being outside the engine speed deadband, and (ii) the throttle position setpoint exceeding the throttle position threshold. See decision 1116 and box 1118 of FIG. 11. The step of gradually transitioning out of the lean-burn mode may include transitioning over a given amount of time.

In another example, the method may include gradually transitioning out of the lean-burn mode in response to: (a) the change in operator demand being inside the delta demand deadband, and (b) at least one of (i) determining that the engine 10 is not running, (ii) determining that a barometric pressure of an atmosphere surrounding the engine 10 is less than a predetermined barometric pressure, (iii) determining that a predetermined engine fault is present, and (iv) determining that a temperature of the engine 10 is less than a predetermined temperature. Each of these other lean-burn enablement criteria was described hereinabove with respect to box 1702 of FIG. 9.

In the above description, certain terms have been used for brevity, clarity, and understanding. No unnecessary limitations are to be inferred therefrom beyond the requirement of the prior art because such terms are used for descriptive purposes and are intended to be broadly construed. The order of method steps or decisions shown in the Figures and described herein are not limiting on the appended claims unless logic would dictate otherwise. It should be understood that the decisions and steps can be undertaken in any logical order and/or simultaneously. The different systems and methods described herein may be used alone or in combination with other systems and methods. It is to be expected that various equivalents, alternatives and modifications are possible within the scope of the appended claims. Each limitation in the appended claims is intended to invoke interpretation under 35 U.S.C. § 112(f), only if the terms "means for" or "step for" are explicitly recited in the respective limitation.

What is claimed is:

1. A method for controlling a marine internal combustion engine, the method being carried out by a control module and comprising:

operating the engine according to a first set of mapped parameter values configured to achieve a first fuel/air equivalence ratio of an air-fuel mixture in a combustion chamber of the engine;

in response to predetermined criteria being met, gradually transitioning to operating the engine according to a second set of mapped parameter values configured to achieve a second, different fuel/air equivalence ratio of the air-fuel mixture in the combustion chamber;

comparing a change in operator demand to a delta demand deadband; and in response to the change in operator demand being outside the delta demand deadband during the step of transitioning, immediately thereafter operating the engine according to the second set of mapped parameter values.

2. The method of claim 1, further comprising comparing a speed of the engine to an engine speed deadband and comparing a throttle position setpoint for the engine to a throttle position threshold;

wherein the predetermined criteria comprise at least one of:

(i) the engine speed is outside the engine speed deadband, and (ii) the throttle position setpoint exceeds the throttle position threshold.

3. The method of claim 2, further comprising determining the change in operator demand by comparing a current operator demand with a filtered operator demand.

4. The method of claim 2, further comprising determining the throttle position threshold based on the engine speed.

5. The method of claim 1, wherein the first and second sets of mapped parameter values correspond to at least one of the following combustion parameters:

a timing of activation of a spark plug associated with the combustion chamber;

a quantity of air to be supplied to the combustion chamber; and a quantity of fuel to be supplied to the combustion chamber.

6. The method of claim 5, wherein the step of gradually transitioning to operating the engine according to the second set of mapped parameter values comprises transitioning from operating the engine according to an initial value of a given combustion parameter determined from the first set of mapped parameter values to operating the engine according to a target value of the given combustion parameter determined from the second set of mapped parameter values at a non-zero rate that is unique to the given combustion parameter.

7. The method of claim 5, wherein the step of gradually transitioning to operating the engine according to the second set of mapped parameter values comprises transitioning from operating the engine according to an initial value of a given combustion parameter determined from the first set of mapped parameter values to operating the engine according to a target value of the given combustion parameter determined from the second set of mapped parameter values utilizing a delay that is unique to the given combustion parameter.

8. The method of claim 1, wherein the first fuel/air equivalence ratio is less than the second fuel/air equivalence ratio.

9. The method of claim 8, wherein the first fuel/air equivalence ratio is less than 1, and the second fuel/air equivalence ratio is at least 1.

10. A method for controlling a marine internal combustion engine, the method being carried out by a control module and comprising:

operating the engine according to a first set of mapped parameter values configured to achieve a first fuel/air equivalence ratio of an air-fuel mixture in a combustion chamber of the engine;

comparing a change in operator demand to a delta demand deadband;

comparing a speed of the engine to an engine speed deadband;

comparing a throttle position setpoint for the engine to a throttle position threshold; and in response to:

(a) the change in operator demand being outside the delta demand deadband, and (b) at least one of:

(i) the engine speed being outside the engine speed deadband, and (ii) the throttle position setpoint exceeding the throttle position threshold, immediately thereafter operating the engine according to a second set of mapped parameter values configured to achieve a second, different fuel/air equivalence ratio of the air-fuel mixture in the combustion chamber.

11. The method of claim 10, wherein the first fuel/air equivalence ratio is less than the second fuel/air equivalence ratio.

12. The method of claim 11, wherein the first fuel/air equivalence ratio is less than 1, and the second fuel/air equivalence ratio is at least 1.

13. The method of claim 10, further comprising gradually transitioning to operating the engine according to the second set of mapped parameter values in response to:

(a) the change in operator demand being inside the delta demand deadband, and (b) at least one of:

(i) the engine speed being outside the engine speed deadband, and (ii) the throttle position setpoint exceeding the throttle position threshold.

14. The method of claim 13, wherein the step of gradually transitioning to operating the engine according to the second set of mapped parameter values comprises transitioning from operating the engine according to an initial value of a given combustion parameter determined from the first set of mapped parameter values to operating the engine according to a target value of the given combustion parameter determined from the second set of mapped parameter values at a non-zero rate that is unique to the given combustion parameter and utilizing a delay that is unique to the given combustion parameter.

15. The method of claim 10, further comprising determining the change in operator demand by comparing a current operator demand with a filtered operator demand.

16. The method of claim 10, further comprising determining the throttle position threshold based on the engine speed.

17. A method for controlling a marine internal combustion engine, the method being carried out by a control module and comprising:

operating the engine in a lean-burn mode, wherein a first fuel/air equivalence ratio of an air-fuel mixture in a combustion chamber of the engine is less than 1;

comparing a change in operator demand to a delta demand deadband;

comparing a speed of the engine to an engine speed deadband;

comparing a throttle position setpoint for the engine to a throttle position threshold;

immediately disabling the lean-burn mode in response to:

(a) the change in operator demand being outside the delta demand deadband, and (b) at least one of:

(i) the engine speed being outside the engine speed deadband, and (ii) the throttle position setpoint exceeding the throttle position threshold; and thereafter operating the engine according to a set of mapped parameter values configured to achieve a second fuel/air equivalence ratio of at least 1.

18. The method of claim 17, further comprising gradually transitioning out of the lean-burn mode in response to:

(a) the change in operator demand being inside the delta demand deadband, and (b) at least one of:

(i) the engine speed being outside the engine speed deadband, and (ii) the throttle position setpoint exceeding the throttle position threshold.

19. The method of claim 18, wherein the step of gradually transitioning out of the lean-burn mode comprises transitioning over a given amount of time.

20. The method of claim 17, further comprising gradually transitioning out of the lean-burn mode in response to:

(a) the change in operator demand being inside the delta demand deadband, and (b) at least one of:

(i) determining that the engine is not running;

(ii) determining that a barometric pressure of an atmosphere surrounding the engine is less than a predetermined barometric pressure;

(iii) determining that a predetermined engine fault is present; and (iv) determining that a temperature of the engine is less than a predetermined temperature.

* * * * *